US011351432B2

(12) United States Patent
Michaelson et al.

(10) Patent No.: US 11,351,432 B2
(45) Date of Patent: Jun. 7, 2022

(54) SOCCER TRAINING DEVICES, SYSTEMS, AND METHODS

(71) Applicant: CHATEM LLC, Shafer, MN (US)

(72) Inventors: John R. Michaelson, Shoreview, MN (US); Elizabeth L. Glenna, Shafer, MN (US); Wade W. Glenna, Shafer, MN (US)

(73) Assignee: Chatem LLC, Arden Hills, MN (US)

( * ) Notice: Subject to any disclaimer, the term of this patent is extended or adjusted under 35 U.S.C. 154(b) by 0 days.

(21) Appl. No.: 17/152,177

(22) Filed: Jan. 19, 2021

(65) Prior Publication Data

US 2021/0213339 A1 Jul. 15, 2021

Related U.S. Application Data

(62) Division of application No. 16/619,597, filed as application No. PCT/US2018/035556 on Jun. 1, 2018, now Pat. No. 10,926,145.

(60) Provisional application No. 62/515,163, filed on Jun. 5, 2017.

(51) Int. Cl.

| | |
|---|---|
| ***A63B 69/00*** | (2006.01) |
| ***A63B 47/02*** | (2006.01) |
| ***A63B 69/40*** | (2006.01) |

(52) U.S. Cl.

CPC ..... *A63B 69/002* (2013.01); *A63B 47/02* (2013.01); *A63B 69/40* (2013.01); *A63B 2209/00* (2013.01)

(58) Field of Classification Search

CPC ..... A63B 69/002; A63B 47/02; A63B 69/40
USPC ..... 473/422, 451, 431, 459, 446, 473, 474, 473/461, 462, 465, 470, 471
See application file for complete search history.

(56) References Cited

U.S. PATENT DOCUMENTS

| | | | |
|---|---|---|---|
| 4,645,210 | A | 2/1987 | Patsy |
| 5,312,109 | A | 5/1994 | Cagle |
| 5,599,025 | A | 2/1997 | Pobee-Mensah |

(Continued)

FOREIGN PATENT DOCUMENTS

| | | |
|---|---|---|
| EP | 3246075 A1 | 11/2017 |
| JP | 2017-000683 | 1/2017 |

(Continued)

OTHER PUBLICATIONS

International Search Report and Written Opinion for PCT/US2018/03556, dated Nov. 1, 2018.

(Continued)

*Primary Examiner* — Mitra Aryanpour
(74) *Attorney, Agent, or Firm* — Patterson Thuente Pedersen, P.A.

(57) ABSTRACT

A soccer training device and system includes a generally horizontal and planar platform and at least one sloped soccer ball collection trough provided generally around a perimeter of the platform. A segmented cage is provided generally at and around outer bounds of, and vertically above, the platform. At least one sensored gate includes at least one soccer ball impact curtain provided above the at least one soccer ball collection trough to direct soccer balls into the trough, and at least one arrangement of sensors to sense presence of the soccer balls that are impacting the at least one curtain. A ball thrower sequentially receives the soccer balls from the silo, to sequentially deliver the soccer balls to a player on the platform. A control panel and a control box control operation of the soccer training device and system.

12 Claims, 30 Drawing Sheets

(56) References Cited

U.S. PATENT DOCUMENTS

| | | | |
|---|---|---|---|
| 7,896,758 | B2 | 3/2011 | Luby |
| 8,480,517 | B2 | 7/2013 | Guttler |
| 8,506,370 | B2 | 8/2013 | Si |
| 8,932,157 | B2 | 1/2015 | Wright |
| 9,266,002 | B2 | 2/2016 | Dunser |
| 9,457,249 | B2 | 10/2016 | Goldberg |
| 10,039,967 | B2 | 8/2018 | Dunser |
| 10,112,094 | B1 | 10/2018 | Odorisio |
| 2004/0266563 | A1 | 12/2004 | Young |
| 2006/0068946 | A1 | 3/2006 | Harrell |
| 2009/0069123 | A1 | 3/2009 | Nugent |
| 2010/0285905 | A1 | 11/2010 | Guttler |
| 2012/0108365 | A1 | 5/2012 | Guttler |
| 2017/0348582 | A1 | 12/2017 | Cho |
| 2020/0009448 | A1 | 1/2020 | Cho |
| 2020/0155912 | A1 | 5/2020 | Michaelson |
| 2020/0187300 | A1 | 6/2020 | Lee |

FOREIGN PATENT DOCUMENTS

| | | |
|---|---|---|
| KR | 10-20010016104 | 3/2001 |
| KR | 20-0343230 | 3/2004 |
| KR | 10-1564190 | 11/2015 |
| WO | WO 2018/226519 A1 | 12/2018 |

OTHER PUBLICATIONS

Application and File History for U.S. Appl. No. 16/619,597, filed Jun. 1, 2018. Inventor: Michaelson et al.

600

700

700

700

900

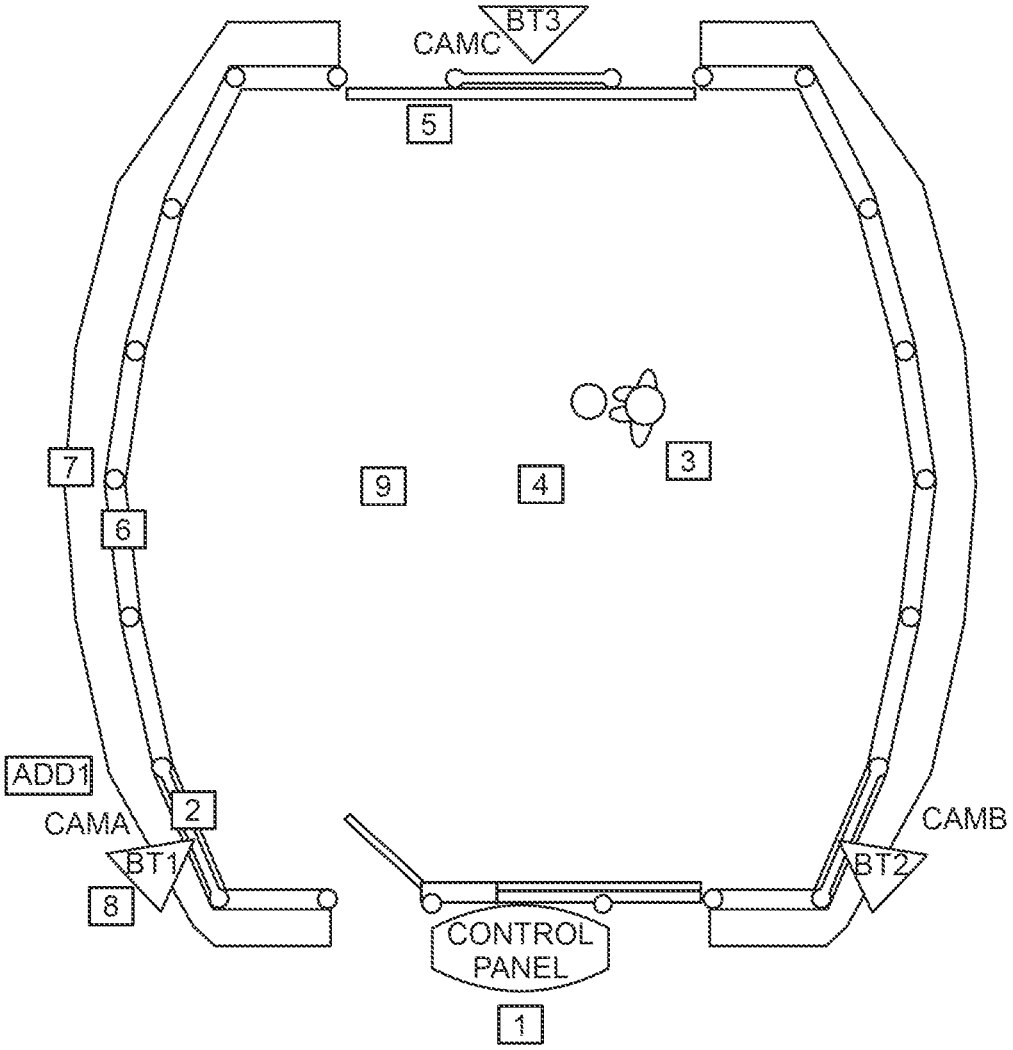

STEP 1: TURN POWER ON, ACTIVATE ALL SENSORS, START BALL MACHINES
STEP 2: BALL IS SENT FROM BALL MACHINE TO WAITING PLAYER ON PLATFORM
STEP 3: PLAYER RECEIVES BALL
STEP 4: IMMEDIATELY AFTER BALL IS SENT, LINE OF BALLS ADVANCED, STAGING NEXT BALL FOR DELIVERY.
STEP 5: {OPTIONAL} PLAYER PLAYS BALL OFF BOUNDING BOARD, RECEIVES AGAIN
STEP 6: PLAYER PASSES BALL THROUGH GATE
STEP 7: BALL HITS DAMPENED CURTAIN, DROPS INTO PERIPHERAL RETURN CHANNEL
STEP 8: NEW BALL DELIVERED TO PLATFORM
STEP 9: BALLS FROM PERIPHERAL RETURN CHANNEL FLOW TO CENTRAL DISTRIBUTION CENTER

ADD1: UPON ACTIVATION, CAMERAS CAPTURE PLAYERS ACTIVITIES

*FIG. 15*

SOCCER TRAINING DEVICES, SYSTEMS, AND METHODS

RELATED APPLICATION

This application is a division of application Ser. No. 16/619,597 filed Dec. 5, 2019, which in turn is a U.S. National Stage of PCT Application No. PCT/US2018/035556, filed Jun. 1, 2018, which claims the benefit of U.S. Provisional Application No. 62/515,163, filed Jun. 5, 2017, each of which is hereby fully incorporated herein by reference.

TECHNICAL FIELD

Subject matter hereof relates generally to athletic training devices, systems, and methods. More specifically, subject matter hereof relates to soccer training devices, systems, and methods.

BACKGROUND

A soccer player's technical skills can be improved dramatically by increasing the accuracy and consistency of soccer balls being delivered to the player during a practice session. It is advantageous for a player to receive repetition in training in a controlled, yet also exciting and enjoyable, environment. Inventors of subject matter hereof have recognized that "Repetition is the Mother of all Learning". Further, aside from training for athletic competitions such as soccer games, it is advantageous to get children involved in physical activity and sports at an early age to improve motor skills and cognitive development.

In most known or traditional soccer training devices, systems, and methods, the percentage of balls delivered accurately and consistently is often extremely low and essentially useless. Being able to pass and receive a ball at higher accuracy and consistency levels provides players with a much more beneficial training program that can dramatically increase player technical skills. An example of a known soccer training device is disclosed in U.S. Pat. No. 9,266,002, entitled "Soccer Training Apparatus," which is incorporated by reference in its entirety herein.

Such known devices and apparatus for soccer training, however, have several deficiencies. It would therefore be advantageous to provide soccer training devices, systems, and methods that tend to keep a continuous passing and receiving "stream" of soccer balls moving to a player throughout a training session. As used throughout this document, the terms "player", "trainee", and "athlete" are each intended to refer to, depending on their context, a user of subject matter herein who is, for example, receiving soccer balls by means of soccer training devices, systems, and methods as described by example or otherwise contemplated herein. Also as used throughout this document, the terms "deliver" and "receive" are intended to refer to, depending on their context, an occurrence of a soccer ball being rolled or otherwise forcibly projected toward a player's feet by the components of the novel and inventive subject matter hereof.

It would also be advantageous to provide soccer training devices, systems, and methods that would deliver balls repetitively and consistently, and that players could then receive and pass through a "gate" that would automatically send another ball of the same or similar pace, rate, or speed to an area near the players repetitively and automatically. Such devices, systems, and methods would make the training environment fun and exciting, to keep the players engaged and active and increase their desire to participate in such technical skill development that may otherwise be considered boring.

Also, it would be advantageous to provide soccer training devices, systems, and methods that would focus and contain development in order for players to have more productive training sessions without having to chase and retrieve balls when mistakes are made. Such devices, systems, and methods would, in an embodiment, contain the balls in a self-retrieving, closed-loop training environment. The training environment would reduce time wasted and decrease frustration levels by allowing players to make mistakes while the system still sends another ball automatically in a timely fashion. Because the balls would be delivered to a player in such a contained environment, the player would receive and pass the ball through a "gate" that would then trigger delivery of another ball to the player in an automated, closed-loop fashion.

Furthermore, providing a "fun factor" to soccer training can be very important for successful outcomes. As aforementioned, traditional training methods can be boring and take a lot of time to get players to adapt or "buy in" to the idea that working on technical aspects (e.g., proper techniques and "ball handling") of soccer at a young age is more important than focusing on tactical aspects. Unfortunately, many coaches and trainers quickly give up on training such technical aspects in order to keep players engaged, and to keep players and parents happy and excited to come back to training and remain on their respective teams. Accordingly, therefore, it would be advantageous to provide soccer training devices, systems, and methods that tend to create environments that include aesthetically pleasing enclosed environments or "cages" and "gates" that may optionally be colored, and also optionally with "piped-in" music, to keep the training environment bright and fun—amenities that are often missing from known or traditional soccer training devices and methods.

SUMMARY

Embodiments described or otherwise contemplated herein substantially meet the aforementioned needs. In particular soccer training devices, systems, and methods, as described by example or otherwise contemplated herein, can utilize an "Automated Receiving Cage" ("ARC") as disclosed herein, being novel and inventive subject matter hereof. The ARC is a closed-loop soccer training device and system that can be used to improve players' technical skills through automated processes of repetitively receiving and then passing or kicking soccer balls. The ARC can be operated continuously, independent of a player, and can include the following components, as will be described in greater detail herein: electro-mechanical ball throwers (e.g., components that deliver soccer balls toward players' feet as aforementioned); ball receiving gates that are adapted to receive and direct balls to other components; sensors for detecting passage of balls into or through the gates; dampened receiving curtains; gravity-assisted or sloped soccer ball collection troughs; push rods and actuators; a Variable Frequency Drive; and a series of wheeled channels. These components can be included in a generally enclosed structure with a platform for training, whereon soccer balls are delivered and received by trainees, and a barrier fence or "cage" that is generally disposed at and around the outer bounds of the platform and vertically above the platform and the ball receiving gates to keep balls contained within the ARC. Irrespective of a particular embodiment, it is to be appreciated and understood that soccer training devices, systems, and methods utilizing ARCs, as described by example or otherwise contemplated herein, can advantageously improve soccer players' technical skills through repetitive receiving and passing of balls in generally controlled training environments. It is also to be appreciated and understood that soccer training devices, systems, and methods utilizing ARCs, as described by example or otherwise contemplated herein, can advantageously increase accuracies and consistencies of balls delivered to trainees and can allow them to work on improving technical skills without relying on other personnel (e.g., players or coaches) to deliver, retrieve, and collect balls. It is also to be appreciated and understood that soccer training devices, systems, and methods utilizing ARCs, as described by example or otherwise contemplated herein, can advantageously allow flexibility and control to ball speed, rotation, and height of balls being delivered to these athletes. Generally, therefore, it is to be understood that soccer training devices, systems, and methods utilizing ARCs, as described by example or otherwise contemplated herein, can advantageously provide relatively controlled environments and consistent training experiences that provide players with training repetition that is usually needed to improve their muscle memory for improved body and foot position that in turn increases coordination and strength when receiving and passing soccer balls.

BRIEF DESCRIPTION OF THE DRAWINGS

Subject matter hereof may be more completely understood in consideration of the following detailed description of various embodiments in connection with the accompanying figures, in which:

FIG. 15 is a top schematic depiction of an overall "process and flow", of the soccer training device and system.

Figure 1:
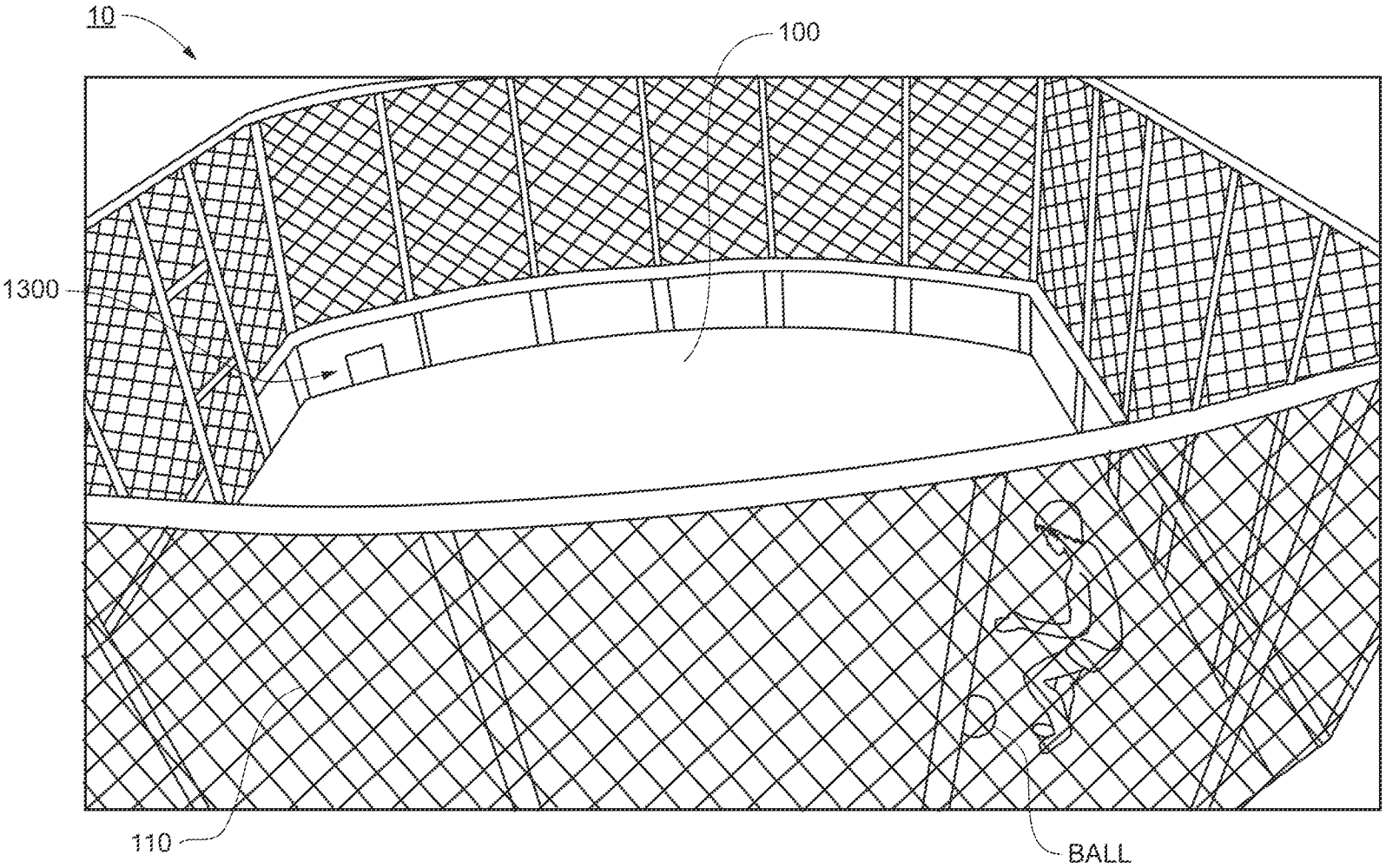
FIG. 1 is an overhead perspective view of an embodiment of a soccer training device and system including an "Automated Receiving Cage" ("ARC") as aforementioned.

While embodiments are amenable to various modifications and alternative forms, specifics thereof have been shown by way of example in the drawings and will be described in detail. It should be understood, however, that the intention is not to limit subject matter hereof to the particular embodiments described. On the contrary, the intention is to cover all modifications, equivalents, and alternatives falling within the spirit and scope of subject matter hereof in accordance with the appended claims.

DETAILED DESCRIPTION

Figure 1A:
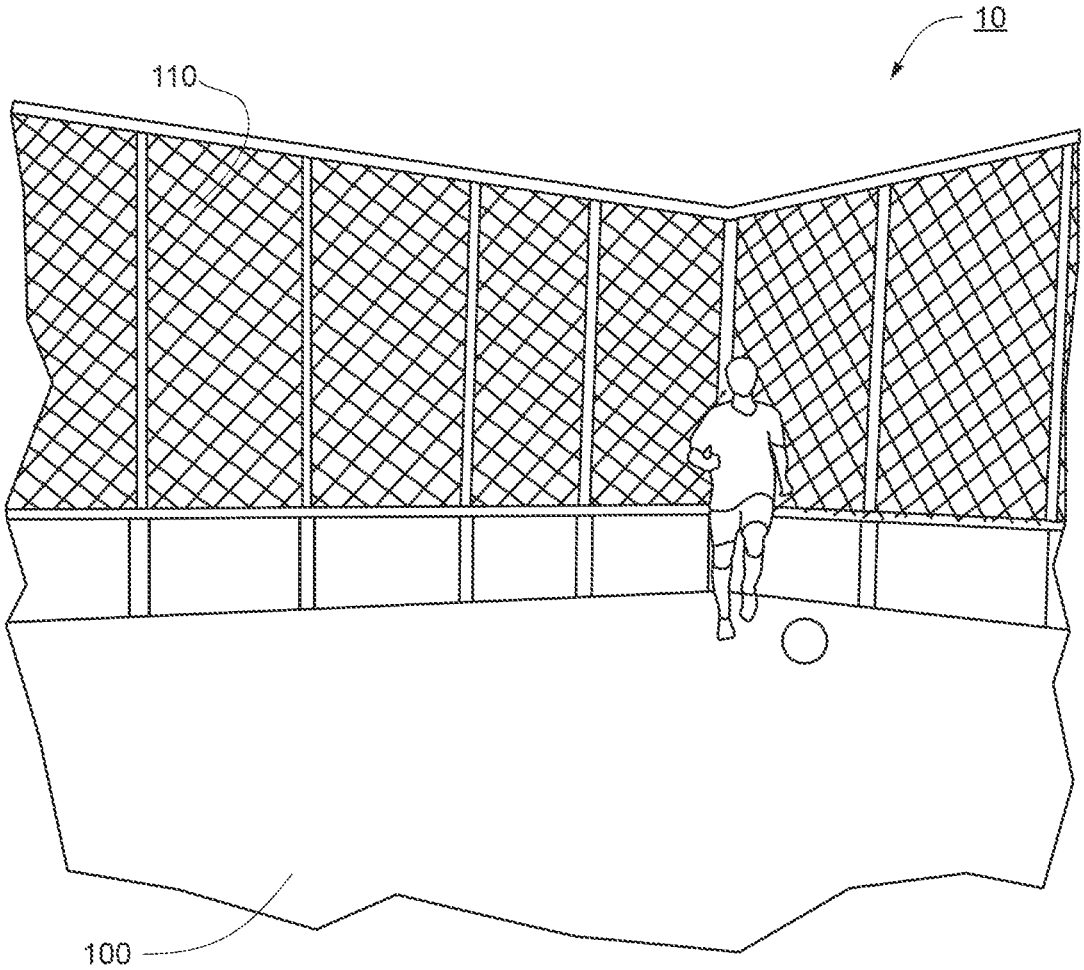
FIG. 1A is a side view of a portion of the embodiment of the soccer training device and system.

With reference to FIG. 1 and FIG. 1A, the inventors of the subject matter hereof determined that building an elevated platform and having soccer balls collected by means of gravity, among other considerations and means, would be an efficient and cost-effective means of providing a soccer training device and system including an "Automated Receiving Cage" ("ARC") 10 as aforementioned. As will be further described, an embodiment of a soccer training device and system including ARC 10 as shown in, for example, FIG. 1 and FIG. 1A, includes a generally horizontal and planar platform 100 with gravity-assisted or sloped soccer ball collection troughs 200 (visible in, e.g., FIG. 2) located generally around a perimeter of platform 100. Troughs 200 are intended to function to direct kicked soccer balls to a central location under platform 100. In an embodiment, platform 100 can include and/or be covered with a suitable surface material such as so-called "artificial turf" to simulate a portion of an actual soccer field or football (soccer) pitch. As noted on FIG. 1, and as will be described, ARC 10 includes a soccer ball thrower 1300 at a partially enclosed location adjacent platform 100. In an embodiment, platform 100 of ARC 10 can have maximum width dimensions of approximately 24 feet by 23 feet, 6 inches, and minimum width dimensions of approximately 19 feet. Troughs 200 can be constructed of generally semi-circular portions of PVC pipe or tube material having an average radius and cross-sectional area to suitably carry and propel soccer balls along their lengths. In an embodiment of ARC 10, generally semi-circular troughs 200 have an average diameter of approximately 9 inches and segmented lengths of approximately 47.5 inches around the perimeter of platform 100 as aforementioned. As aforementioned, and as shown in FIG. 1 and FIG. 1A, a suitable segmented fence or "cage" 110 is provided generally at and around outer bounds of, and vertically above, platform 100 to keep balls contained within ARC 10 when in use.

Figure 2:
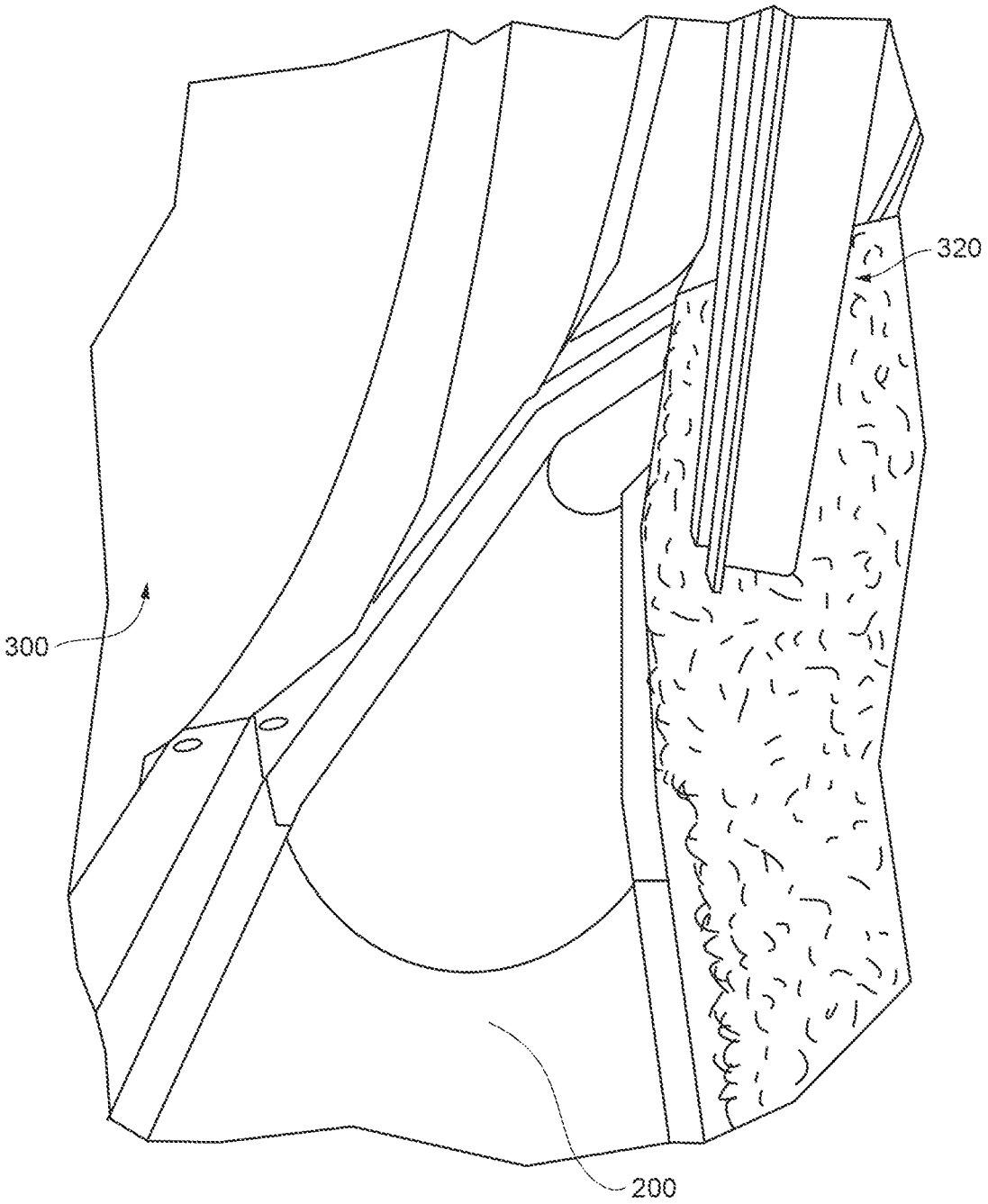
FIG. 2 is a perspective view of a portion of ball collection troughs, of the soccer training device and system.

In operation and use of a soccer training device and system including ARC 10, with reference to FIG. 2 and FIG. 3, and as will be described, soccer balls are kicked toward and against ball impact "curtains" 300 that are located sequentially about a perimeter of platform 100 with peripheral ball collection troughs 200 adjacent and below curtains 300. Curtains 300 are intended to stop the kicked balls and direct them into troughs 200. It was initially believed that rather rudimentary curtains of vinyl material would be sufficient to absorb average impact forces of kicked soccer balls in ARC 10, allowing them to fall as intended into associated ball collection troughs 200. But when balls were kicked with higher forces and rotational velocities toward the curtains, percentages of balls failing to fall successfully into the collection troughs (and subsequently travel down under platform 100 to a distribution center and central landing zone, as will be described) were inadequately high. It was then discovered by inventors of the subject matter hereof that a "Mass Loaded Vinyl" ("MLV") material was needed for curtains 300, to adequately and consistently absorb such higher forces and velocities and thus significantly and advantageously decrease the percentages of balls not falling into troughs 200.

Figure 3:
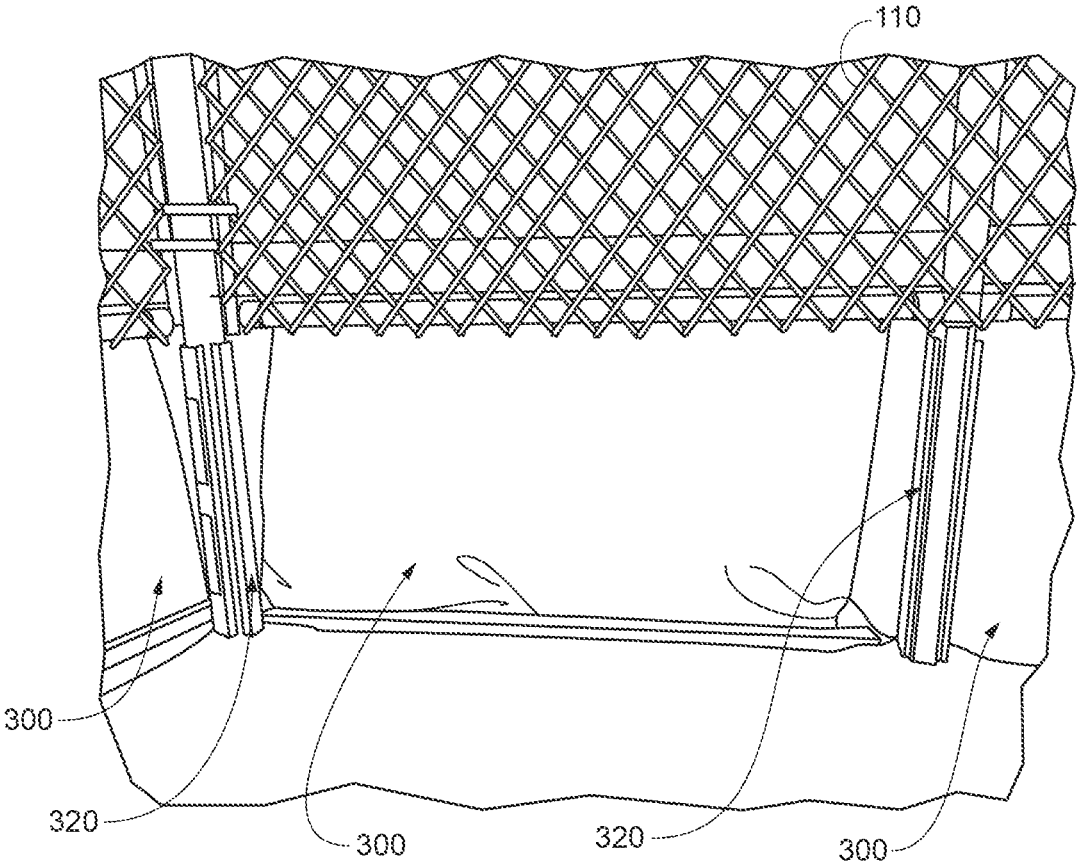
FIG. 3 is a front view of a ball impact curtain and associated components, of the soccer training device and system.
Figure 3A:
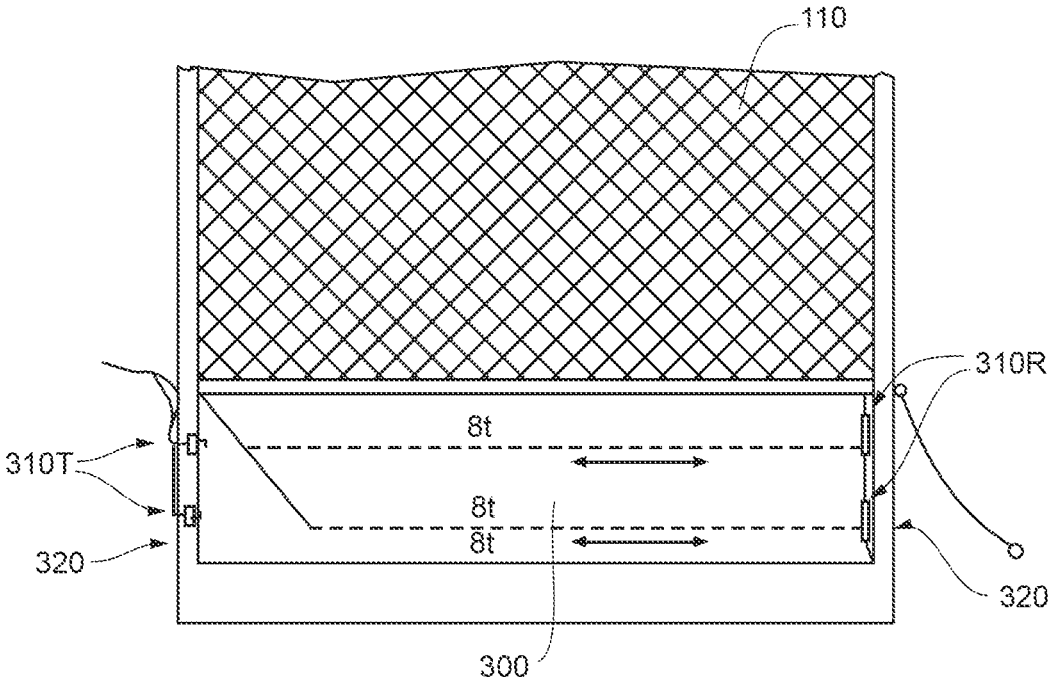
FIG. 3A is a schematic depiction of the ball impact curtain and associated components shown in FIG. 3.
Figure 3B:
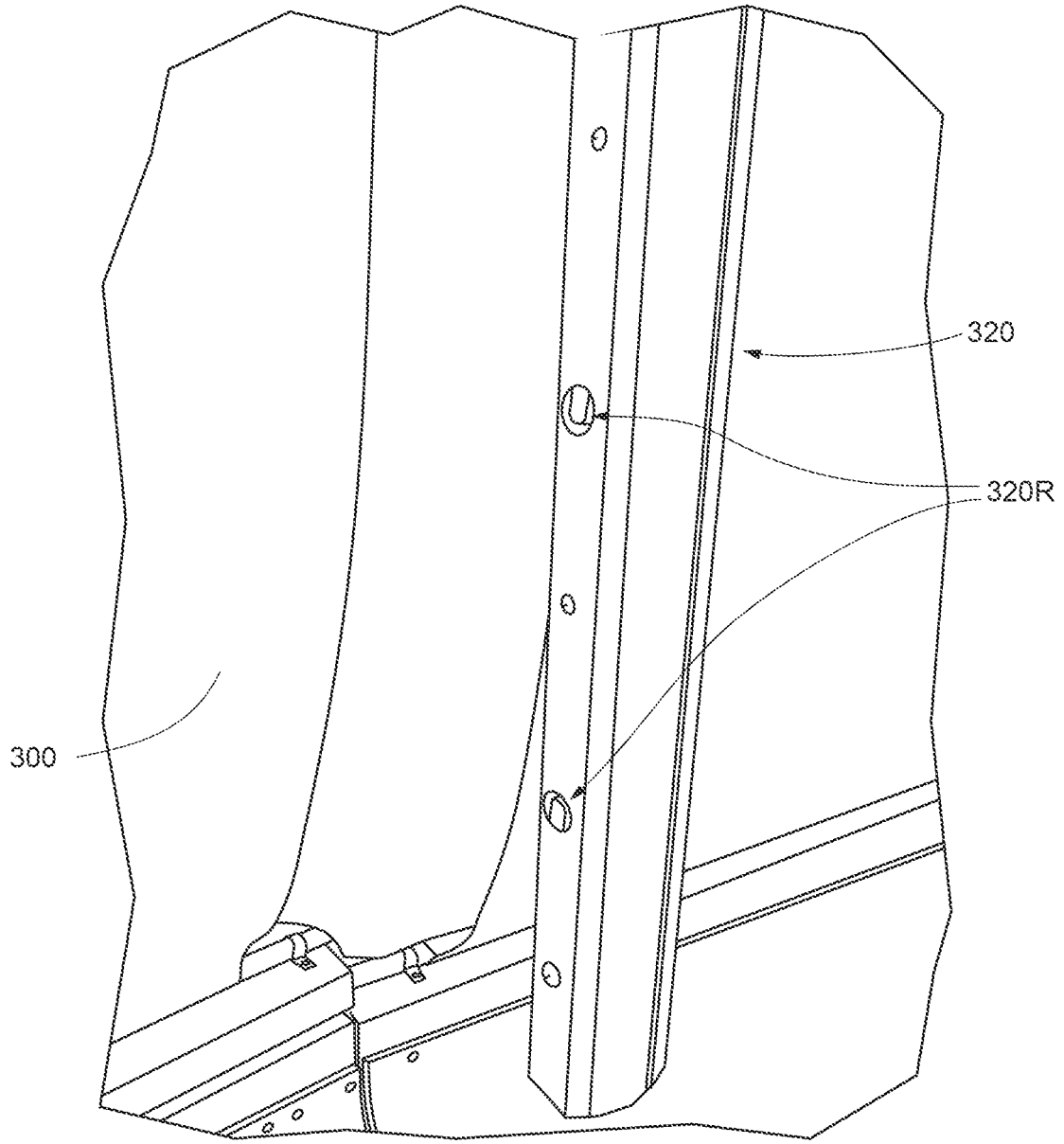
FIG. 3B is a magnified view of a portion of the ball impact curtain and associated components shown in FIG. 3.

In an embodiment of a soccer training device and system, and with reference to FIG. 3, FIG. 3A, and FIG. 3B, ARC 10 includes arrangements of optical sensors including transmitters 310T and receivers 310R that are provided on support posts 320 on opposite sides of curtains 300. As will be further described, the optical sensors function in operation of ARC 10 to detect balls that have been kicked and are impacting an adjacent curtain 300 just before falling into a trough 200. It is to be understood that arrangements of curtains 300, optical sensors including transmitters 310T and receivers 310R, and their support posts 320, together comprise "sensored gates" in ARC 10 as will be described.

Figure 4:
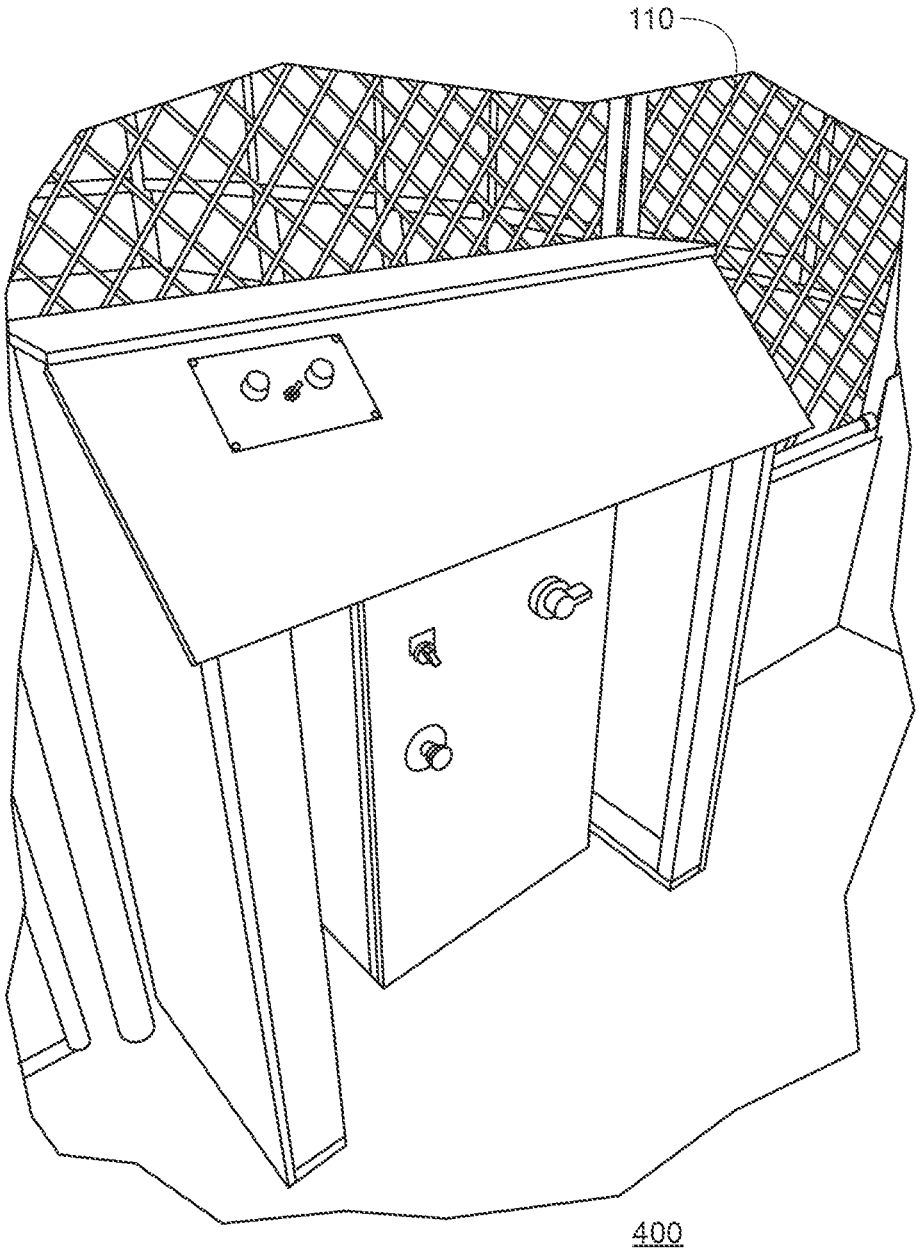
FIG. 4 is a perspective view of a control panel, of the soccer training device and system.
Figure 4A:
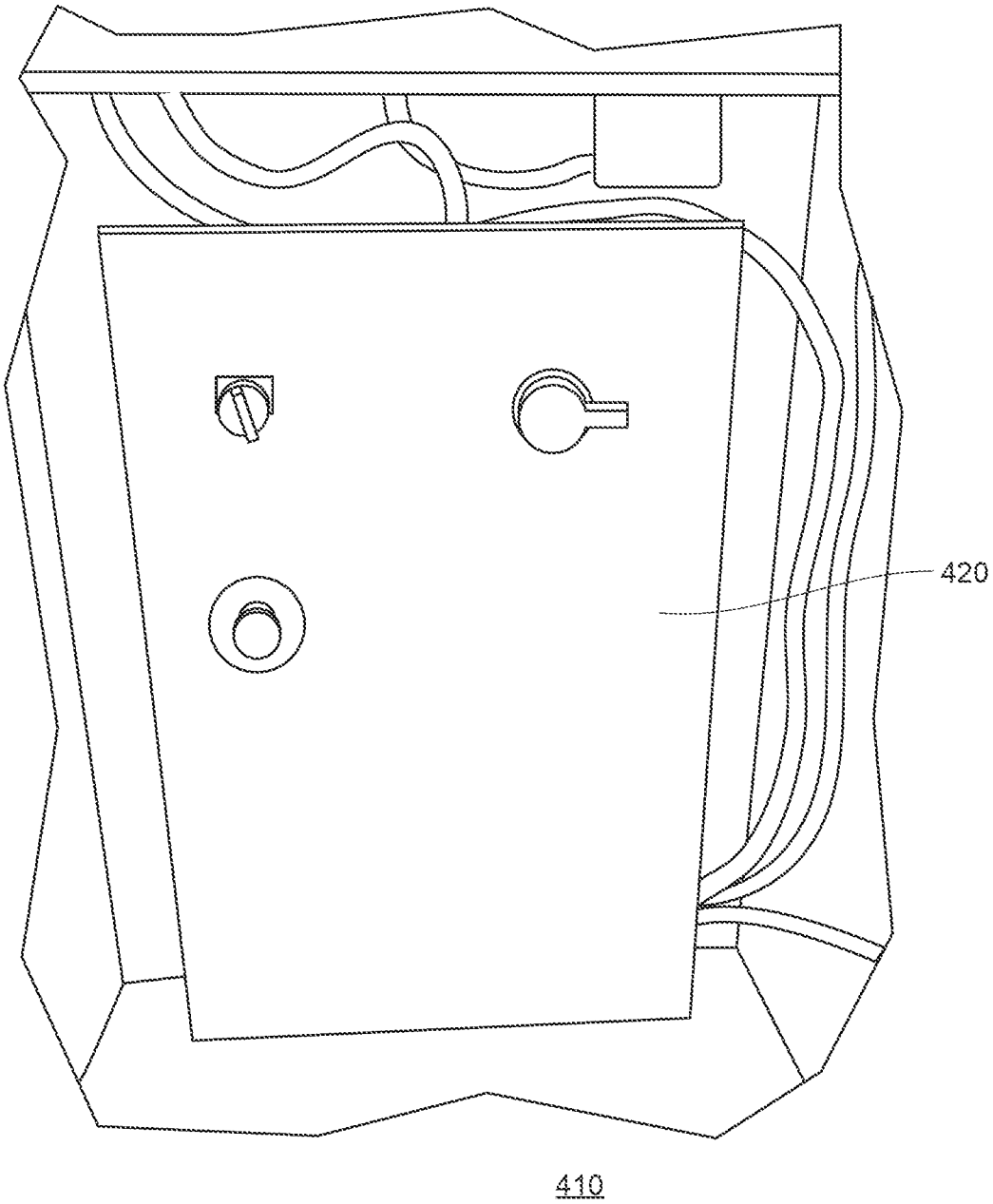
FIG. 4A is a front view of a control box, of the soccer training device and system.

As shown in FIG. 4 and FIG. 4A, a control panel 400 with a control box 410 adjacent platform 100 and preferably outside of cage 110, provide controlling means for operation of ARC 10, among other components that will be described. Generally, control panel 400 and control box 410 can include suitable mechanical and electrical components such as knobs, buttons, dials, wiring, circuits, and the like to control the operation and use of ARC 10 in an embodiment of a soccer training device and system. Control box 410 can also include a "Variable Frequency Drive" ("VFD") 420 as will be described. Optionally, a wired or wireless hand-held electric triggering means (not illustrated) can be provided to interact with control panel 400 and/or control box 410 to, for example, alert and/or command VFD 420 to complete a cycle of operation of ball thrower 1300 (as will be described) and thereby reset the soccer training device and system after any "jam" or other abnormality in operation of ARC 10 temporarily slows or otherwise disrupts distribution or delivery of a ball or balls from the central location.

Figure 5:
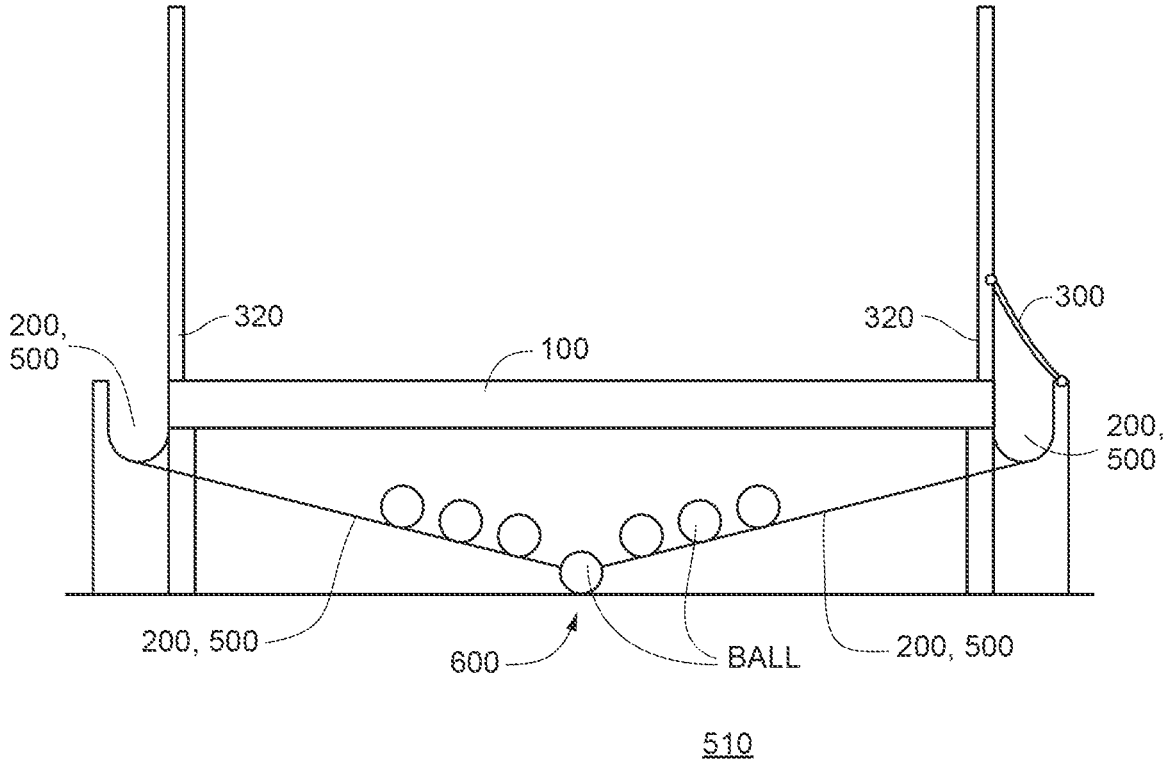
FIG. 5 is a schematic depiction of a side view of a distribution center and central landing zone, of the soccer training device and system.
Figure 5A:
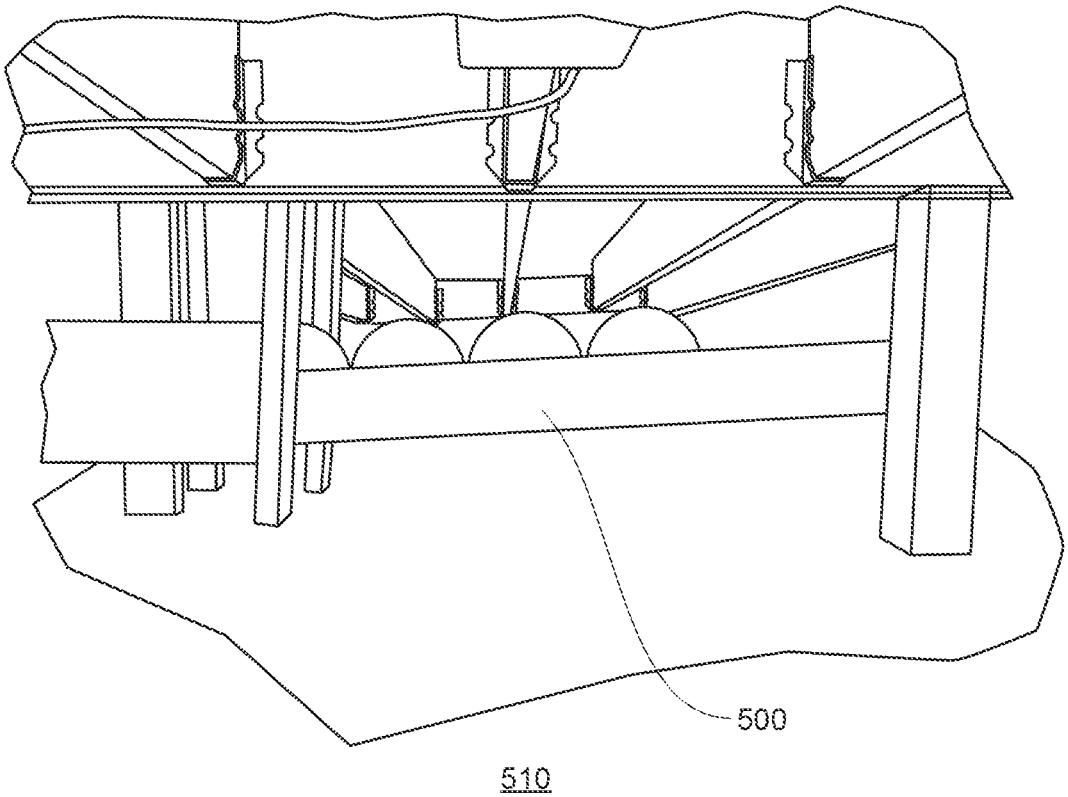
FIG. 5A is a side view of components depicted in FIG. 5.
Figure 5B:
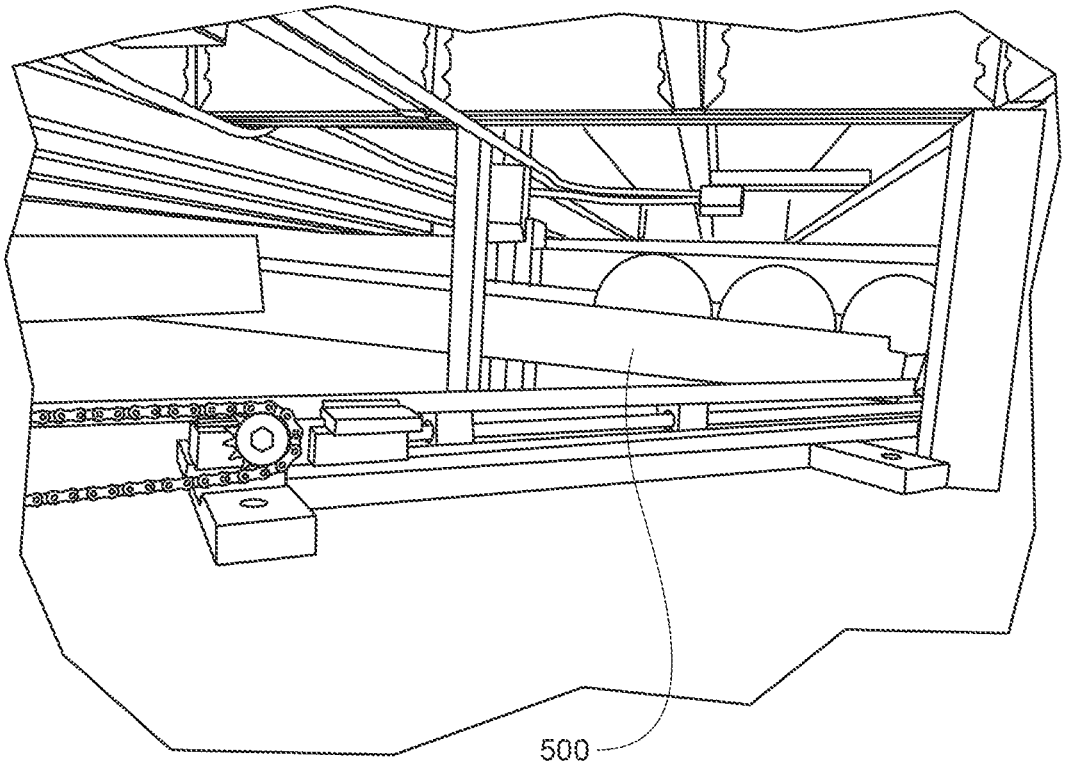
FIG. 5B is a side view of other components depicted in FIG. 5.
Figure 6:
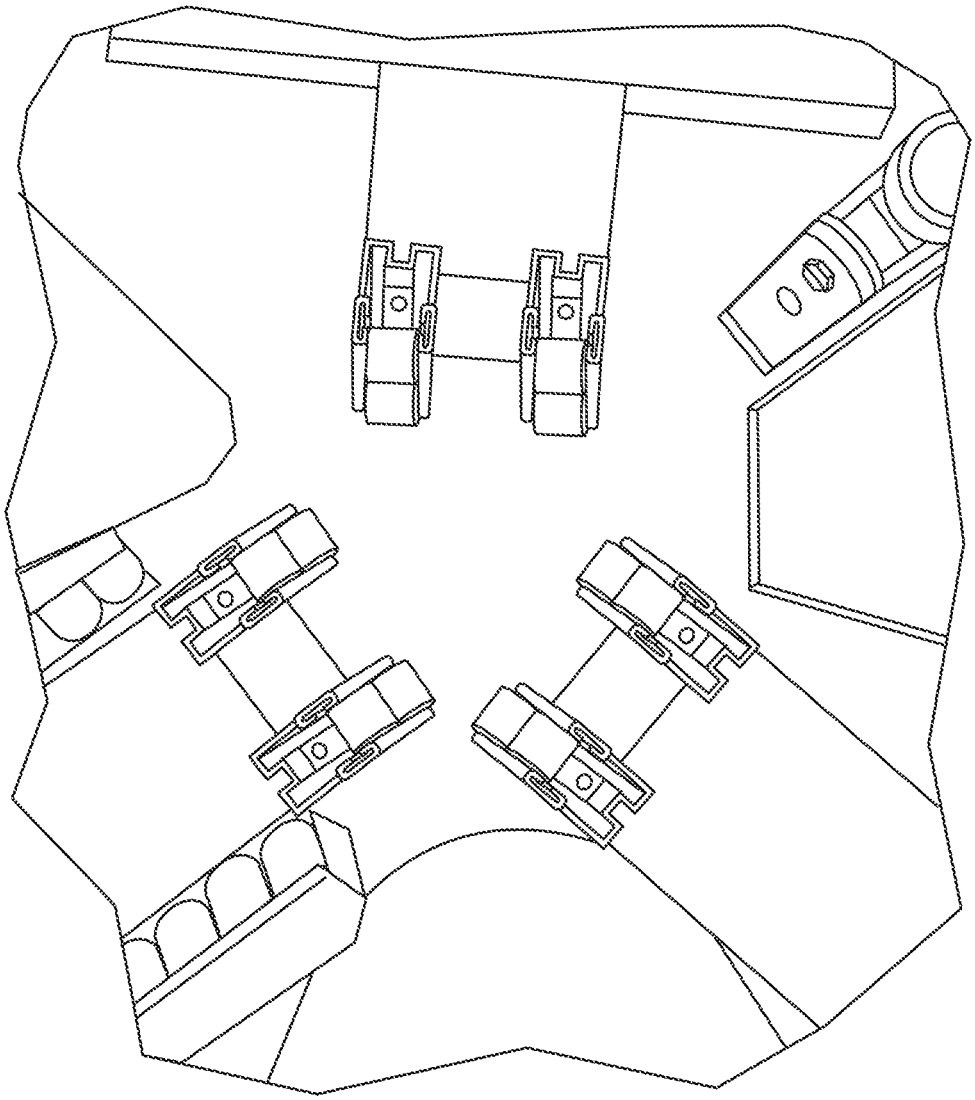
FIG. 6 is a magnified top view of the central landing zone, of the soccer training device and system.
Figure 6A:
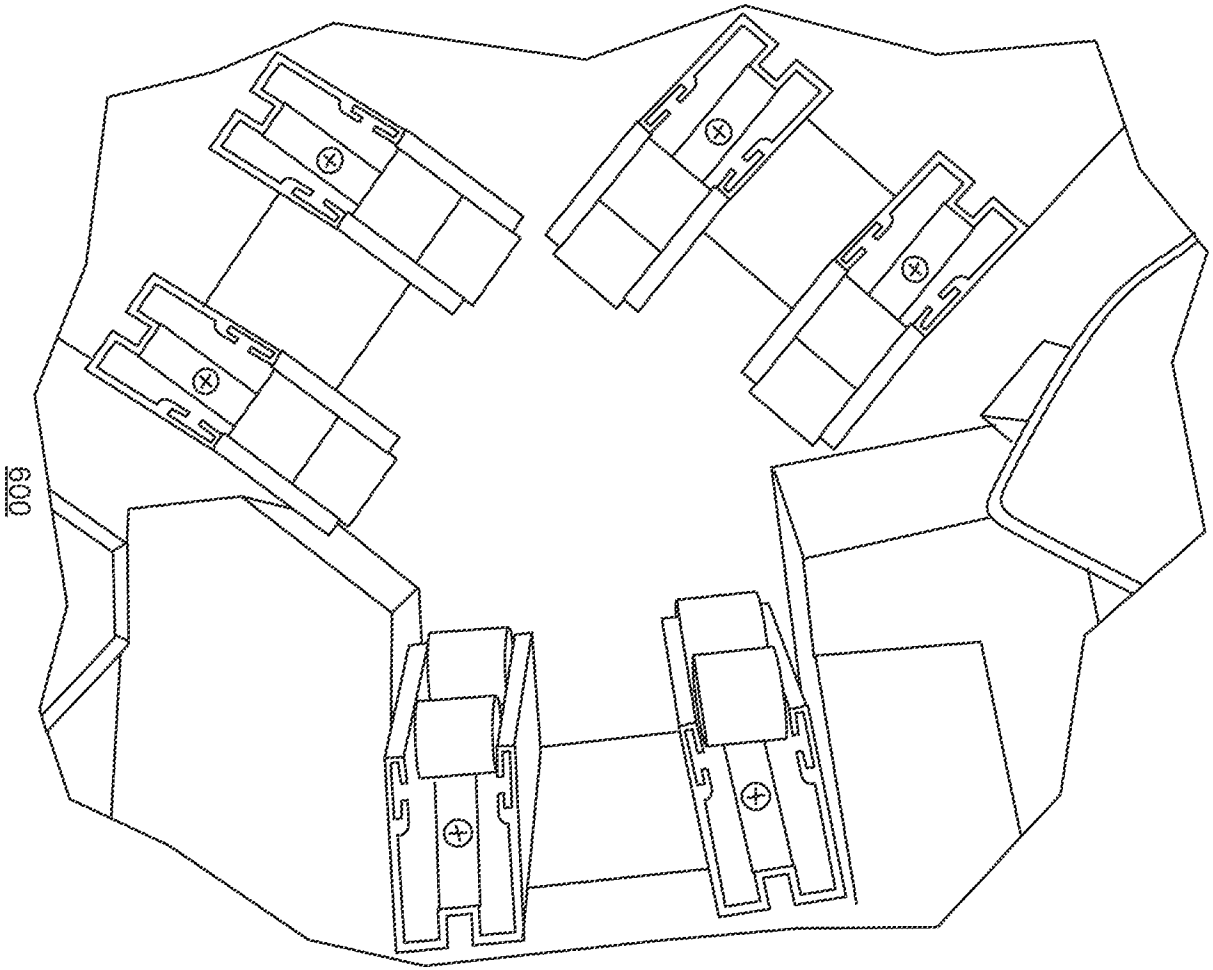
FIG. 6A is another magnified top view of the central landing zone, of the soccer training device and system.
Figure 7:
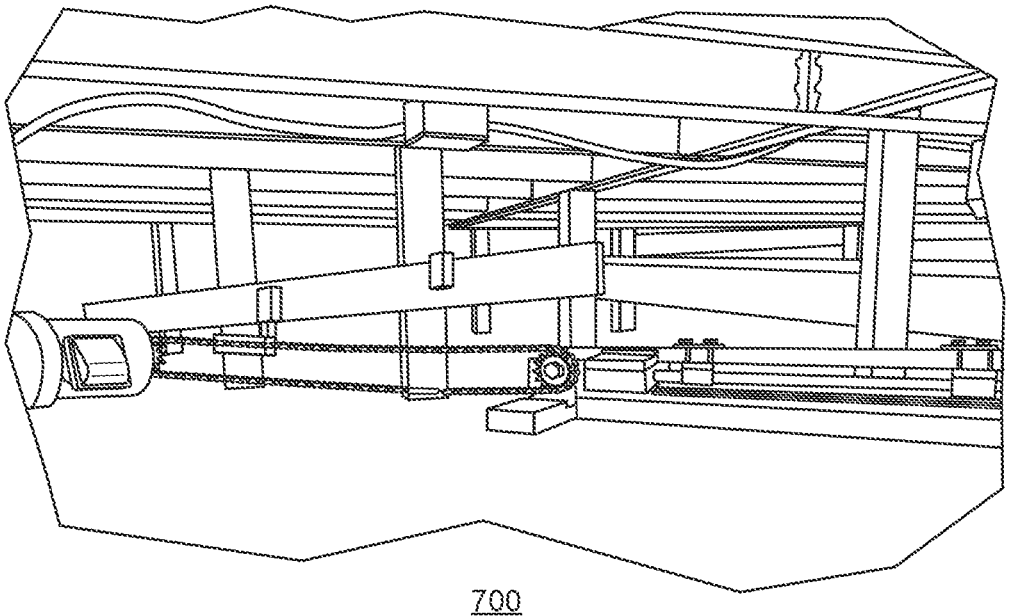
FIG. 7 is a perspective view of components in the distribution center, of the soccer training device and system.
Figure 7A:
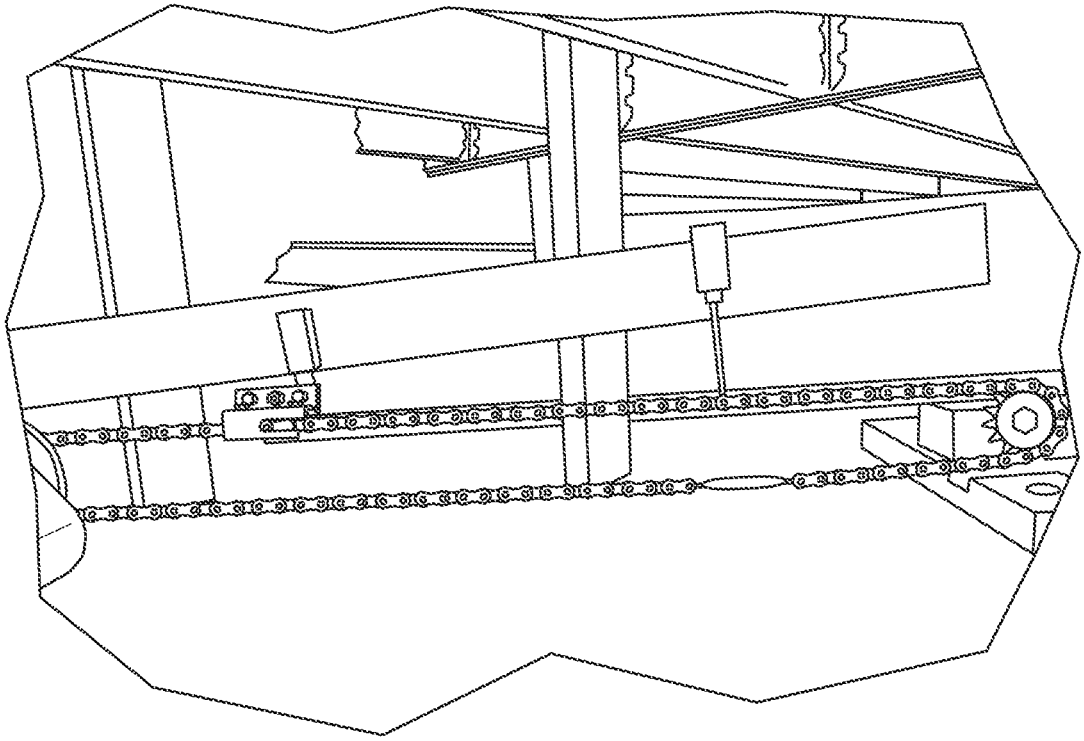
FIG. 7A is a magnified side view of components in the distribution center shown in FIG. 7.
Figure 7B:
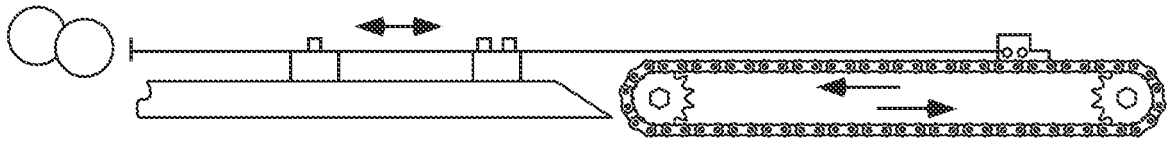
FIG. 7B is a schematic depiction of the components in the distribution center shown in FIG. 7A.
Figure 8:
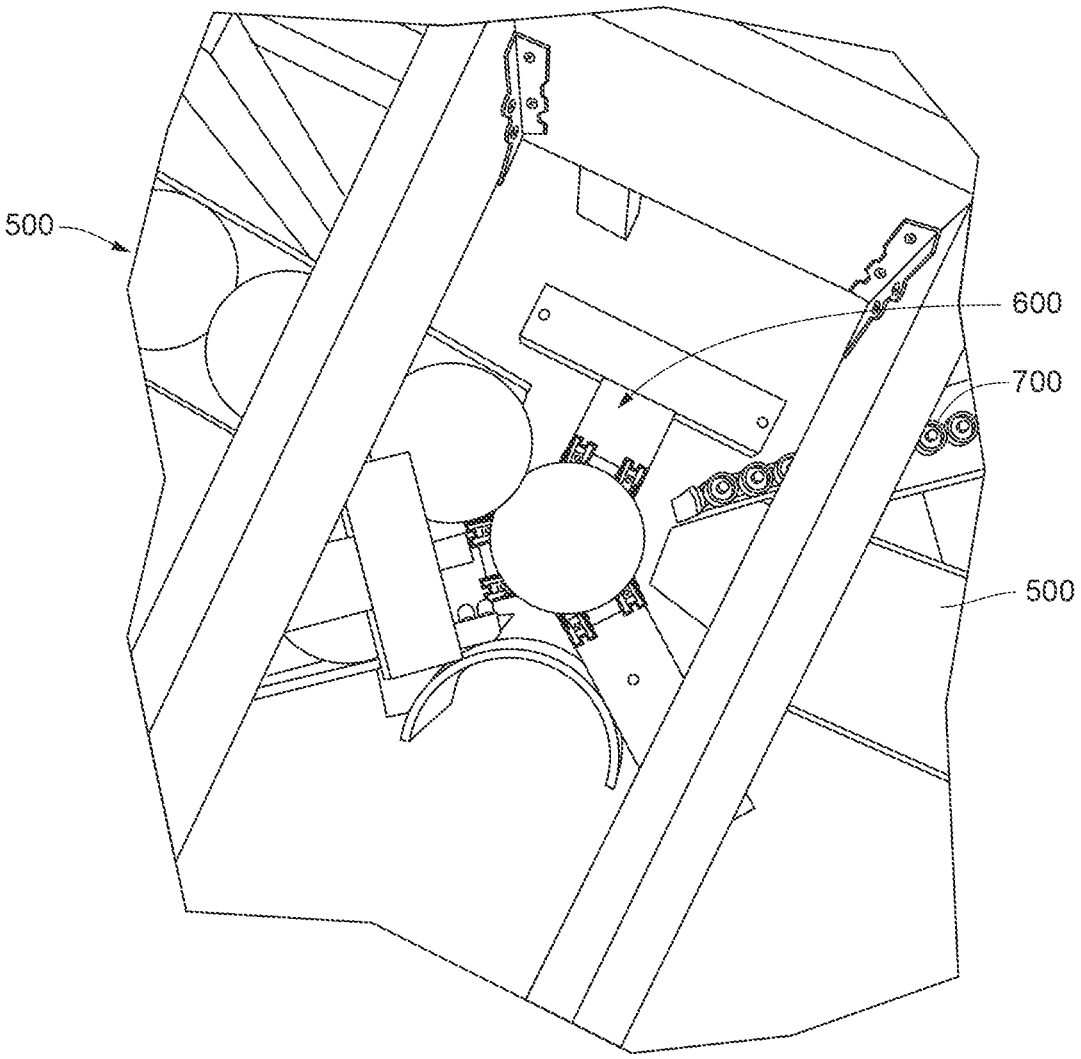
FIG. 8 is a top view of components in the distribution center and central landing zone, with a portion of an overlying platform removed so that the components are visible.
Figure 9:
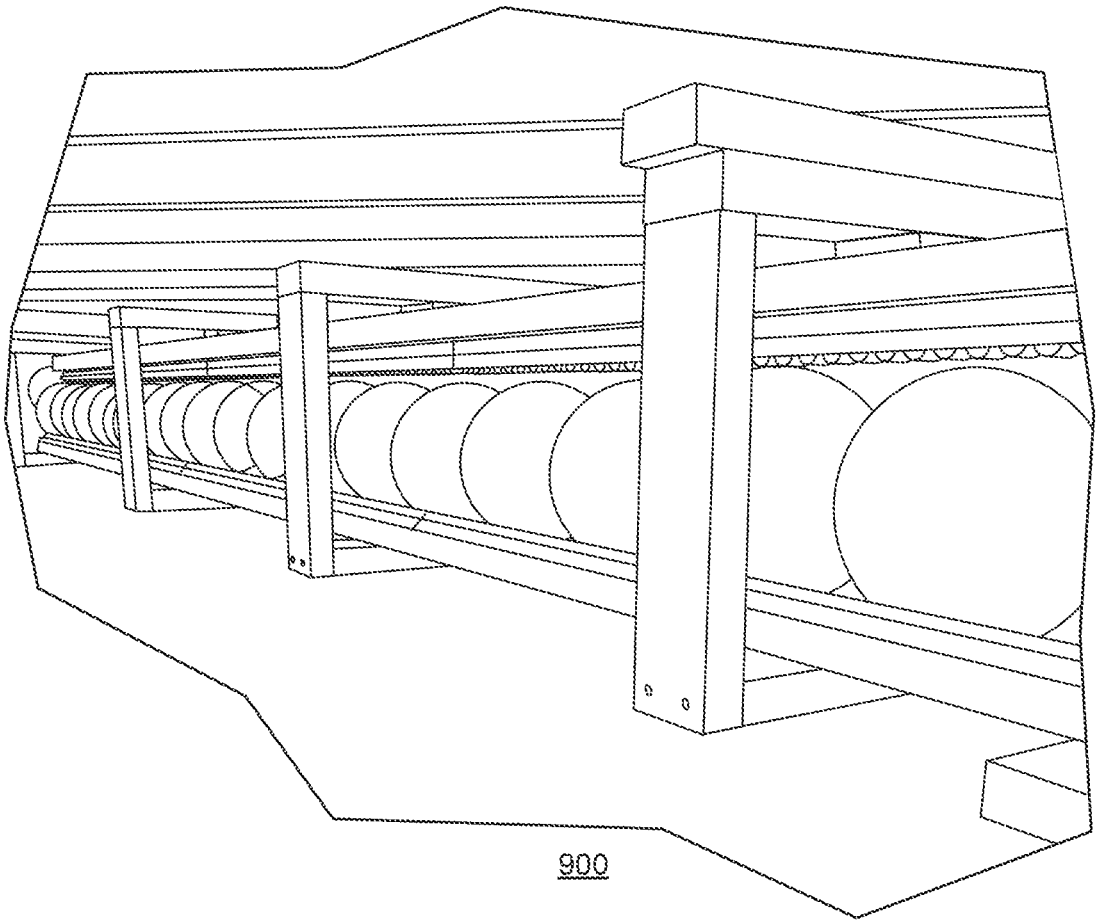
FIG. 9 is a perspective view of a wheeled channel, of the soccer training device and system.
Figure 10:
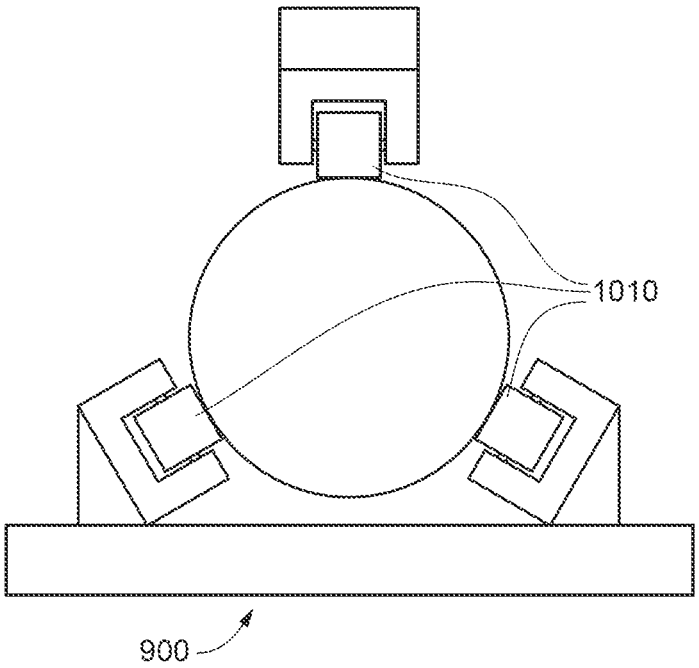
FIG. 10 is a schematic side depiction of the wheeled channel.

In an embodiment of a soccer training device and system including ARC 10, components mostly under platform 100 for moving soccer balls to a location of thrower 1300 are shown generally in FIG. 5 through FIG. 10B. After a soccer ball is kicked across a portion of platform 100 and stopped by a curtain 300, the ball falls into a trough 200 as aforementioned. Troughs 200 then send the balls by gravity to one of several sloped return chutes 500 (two chutes 500 are illustrated in FIG. 5) that then direct the balls by gravity to a distribution center 510 including a central landing zone 600 for the balls as shown in FIG. 5, FIG. 5A, FIG. 5B, FIG. 6, and FIG. 6A. With reference to FIG. 7, FIG. 7A, FIG. 7B, and FIG. 8 (a top view), the balls are then sequentially driven by a motorized gear and push arm assembly 700 into a wheeled channel 900 as shown in FIG. 9 and FIG. 10. In an embodiment of ARC 10, as particularly shown in FIG. 10, wheels 1010 provided with channel 900 tend to advantageously decrease friction between the balls and channel 900 to thereby allow the balls to glide or move relatively freely as they are advanced sequentially through channel 900. In an embodiment, channel 900 and/or wheels 1010 can be adaptable to varying sizes of soccer balls.

Figure 10A:
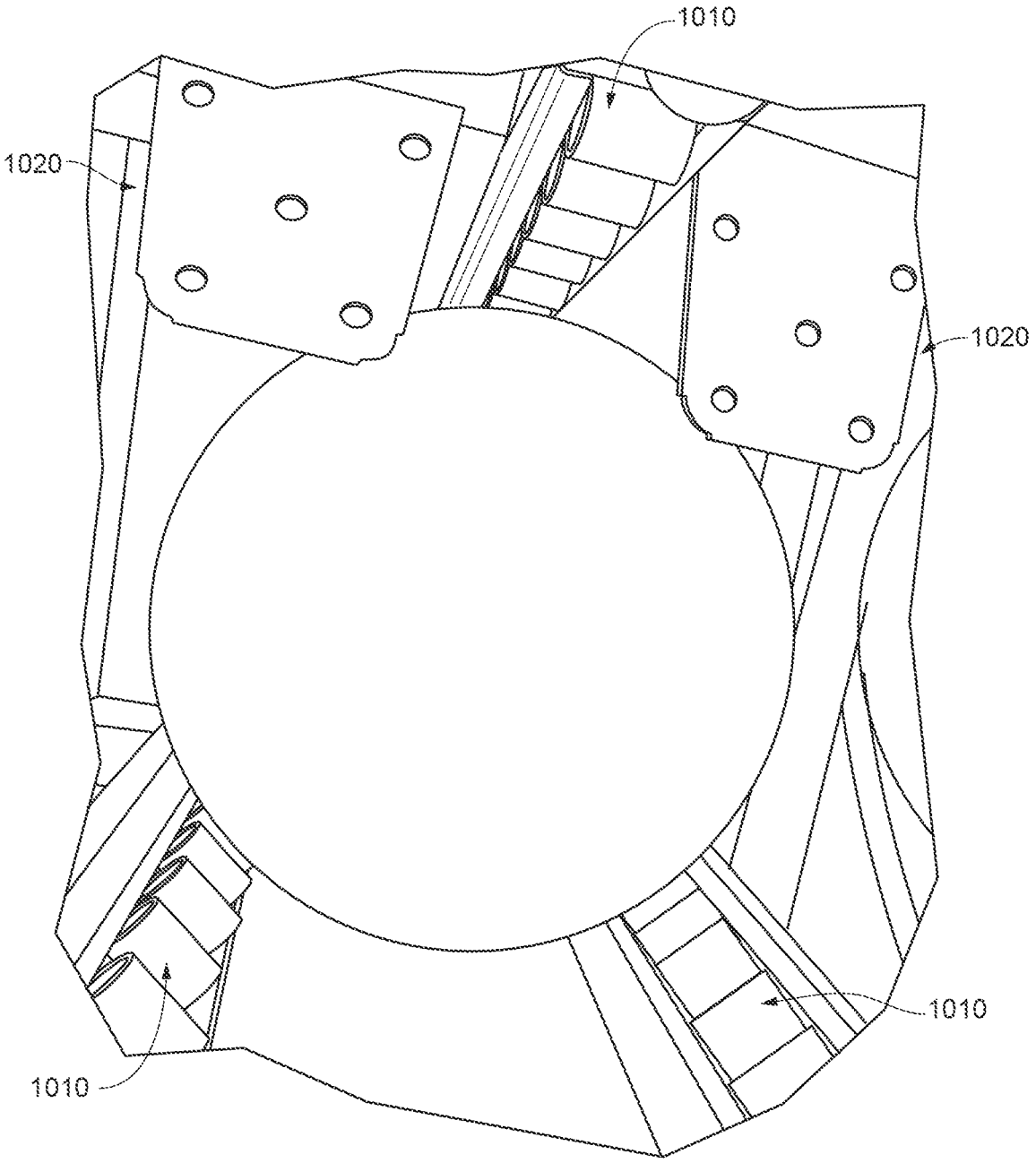
FIG. 10A is a view of a component of the wheeled channel adjacent the central landing zone.
Figure 10B:
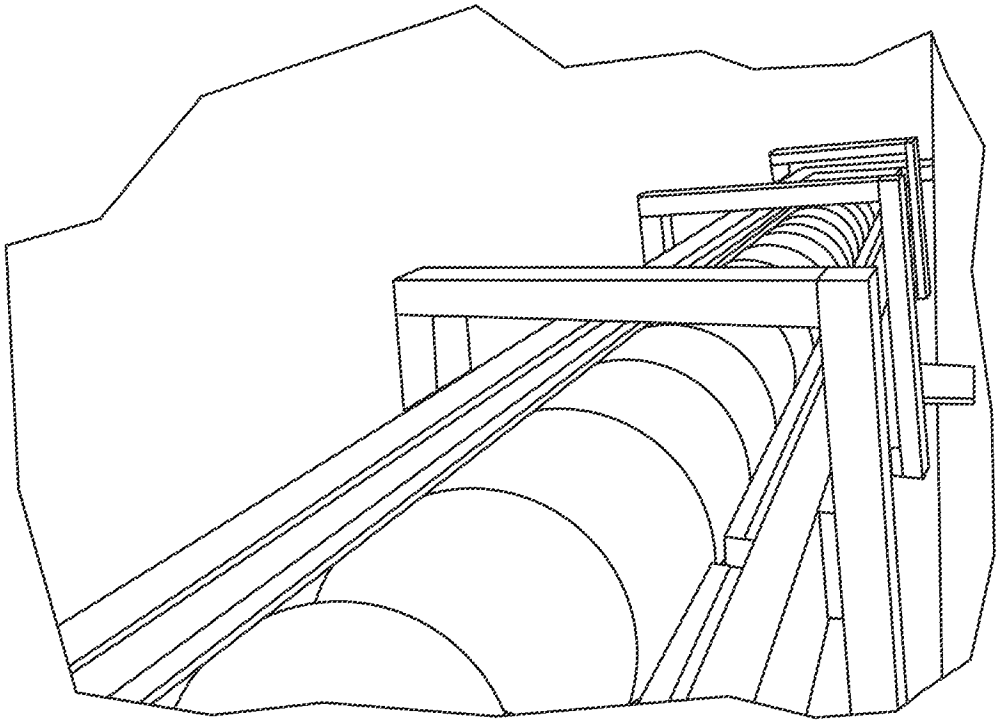
FIG. 10B is a perspective view of the wheeled channel.
Figure 11:
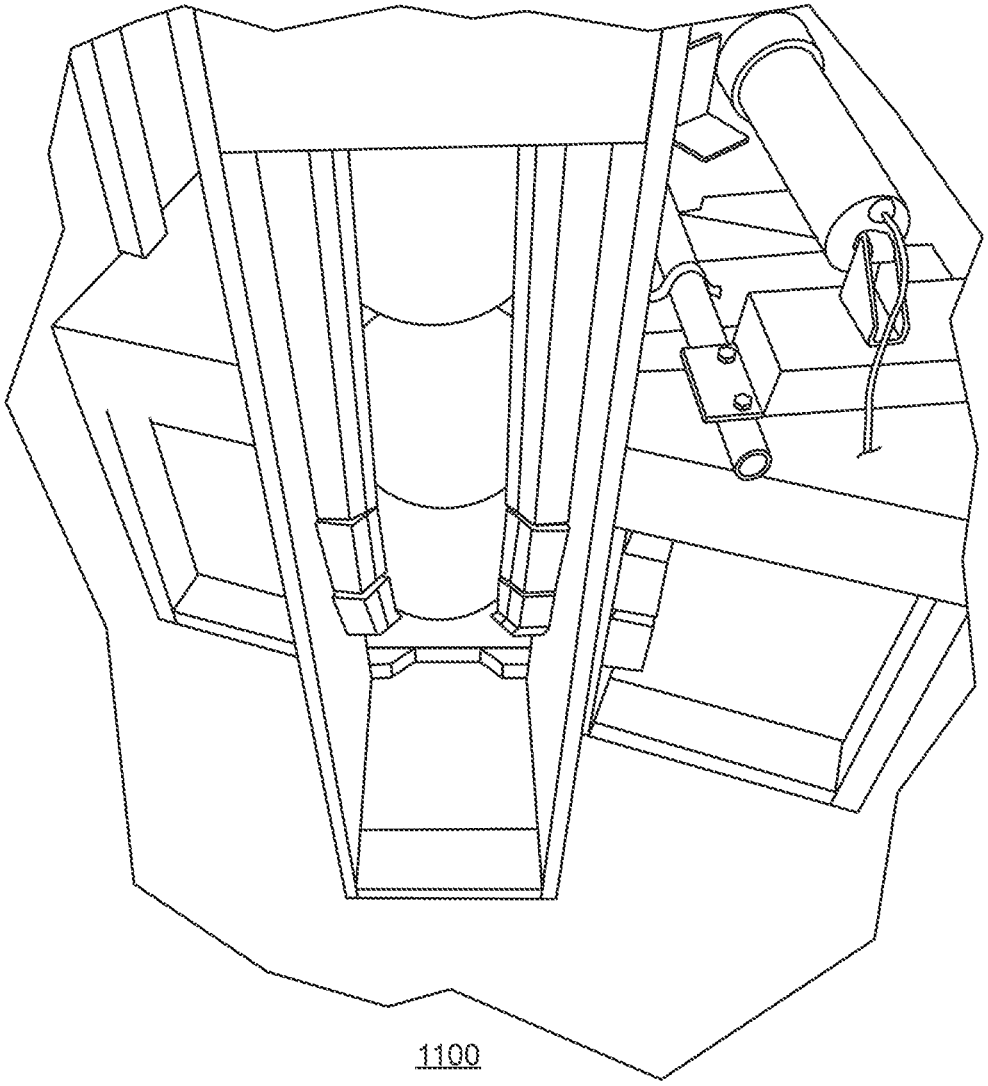
FIG. 11 is a rear perspective view of a silo, of the soccer training device and system.
Figure 12:
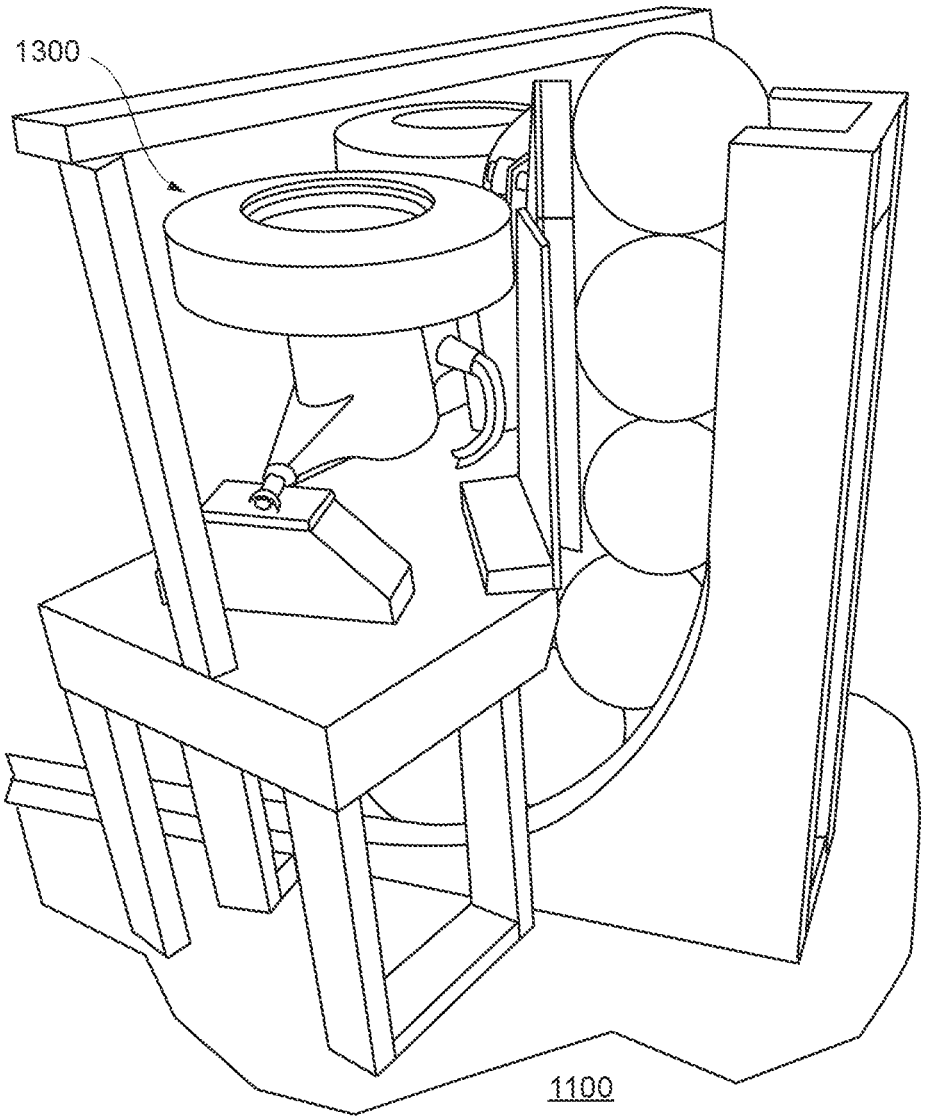
FIG. 12 is a side view of the silo.

As illustrated in FIG. 10A, a containment device in channel 900 comprising spring-hinged ball holders 1020 can hold a ball from unwanted movement in channel 900 backwardly toward central landing zone 600 after the ball has been driven by assembly 700 from zone 600 into channel 900.

With reference now to FIG. 10B, FIG. 11, FIG. 12, and FIG. 13, in an embodiment of a soccer training device and system including ARC 10, it is to be understood that components therein depicted function to sequentially move soccer balls from the distribution center 510 and central landing zone 600 by way of motorized gear and push arm assembly 700, and wheeled channel 900, into a ball supply chute or "silo" 1100. It is to be understood that soccer balls that reside in and move through channel 900, and up through silo 1100, are forcibly moved there along by sequential addition of balls to channel 900 by push arm assembly 700 in controlled reactive fashion analogous in some respects to a "domino effect". Spatially and dimensionally, as shown in the figures, silo 1100 can be characterized as a continuation of channel 900 that is curved upwardly to a generally vertical orientation relative to platform 100, at an end proximal and adjacent to ball thrower 1300 as will be described. Silo 1100 is intended to function by sequentially guiding the soccer balls from the generally horizontal channel 900 into a generally vertical supply column to thrower 1300 as will be described.

Although not illustrated, it is to be appreciated and understood that motive forces to the balls, as provided by components such as, for example, motorized gear and push arm assembly 700 and thrower 1300, could alternatively or additionally be provided by other suitable techniques such as by air-driven systems and slide-driven systems, etc.

Figure 13:
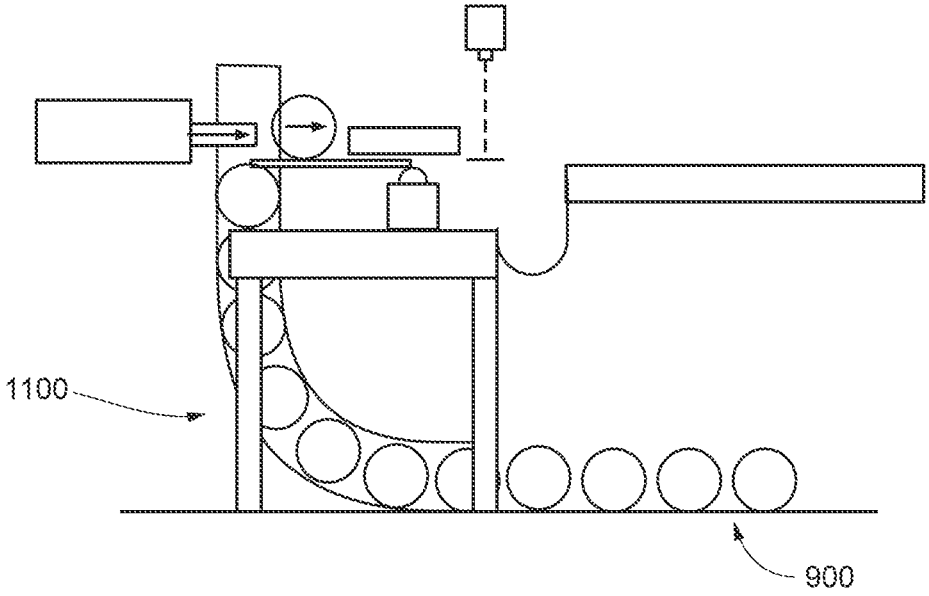
FIG. 13 is a schematic depiction of an opposite side view of the silo.
Figure 13A:
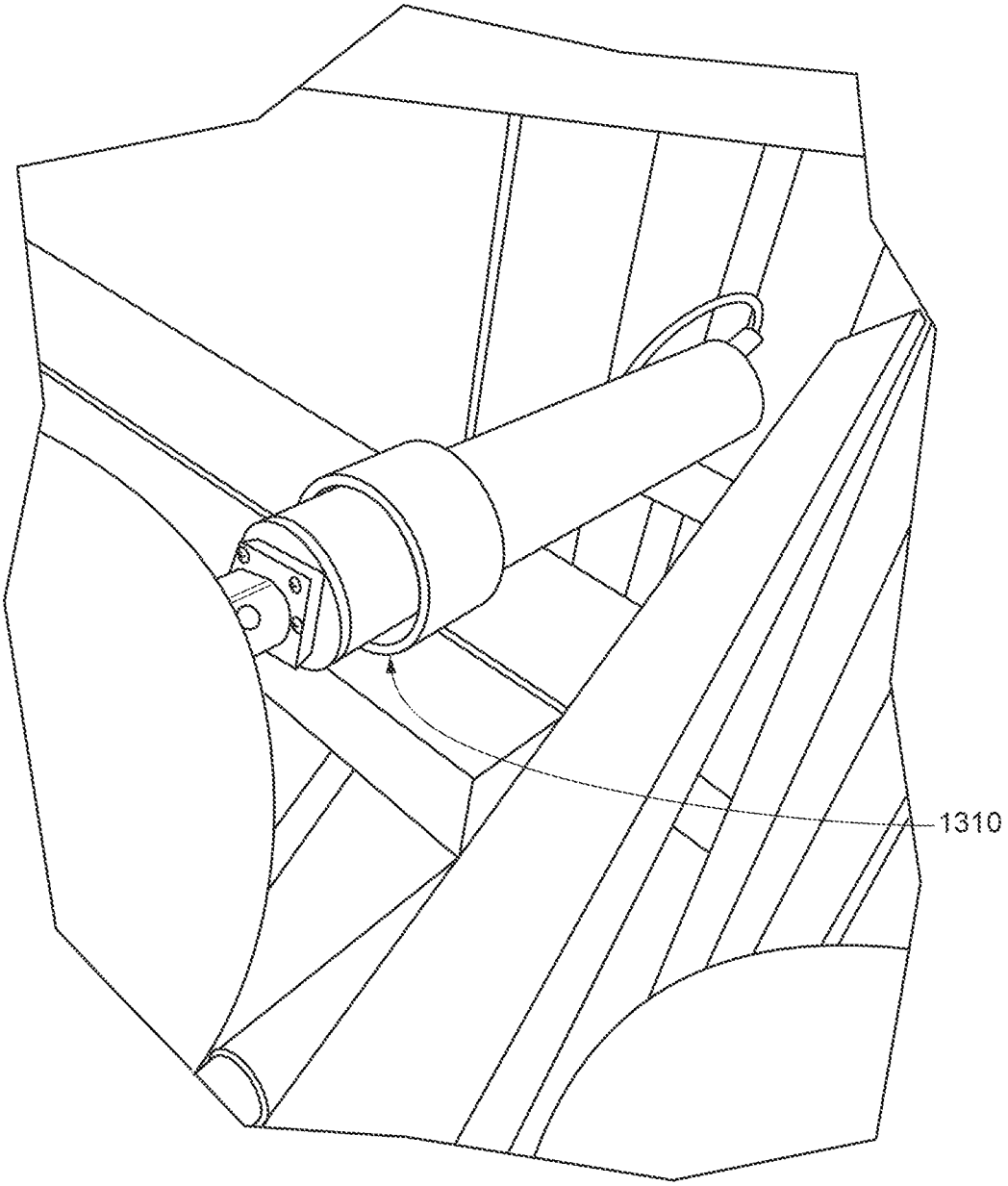
FIG. 13A is a view of a component, adjacent the silo, that functions cooperatively with a ball thrower, of the soccer training device and system.
Figure 13B:
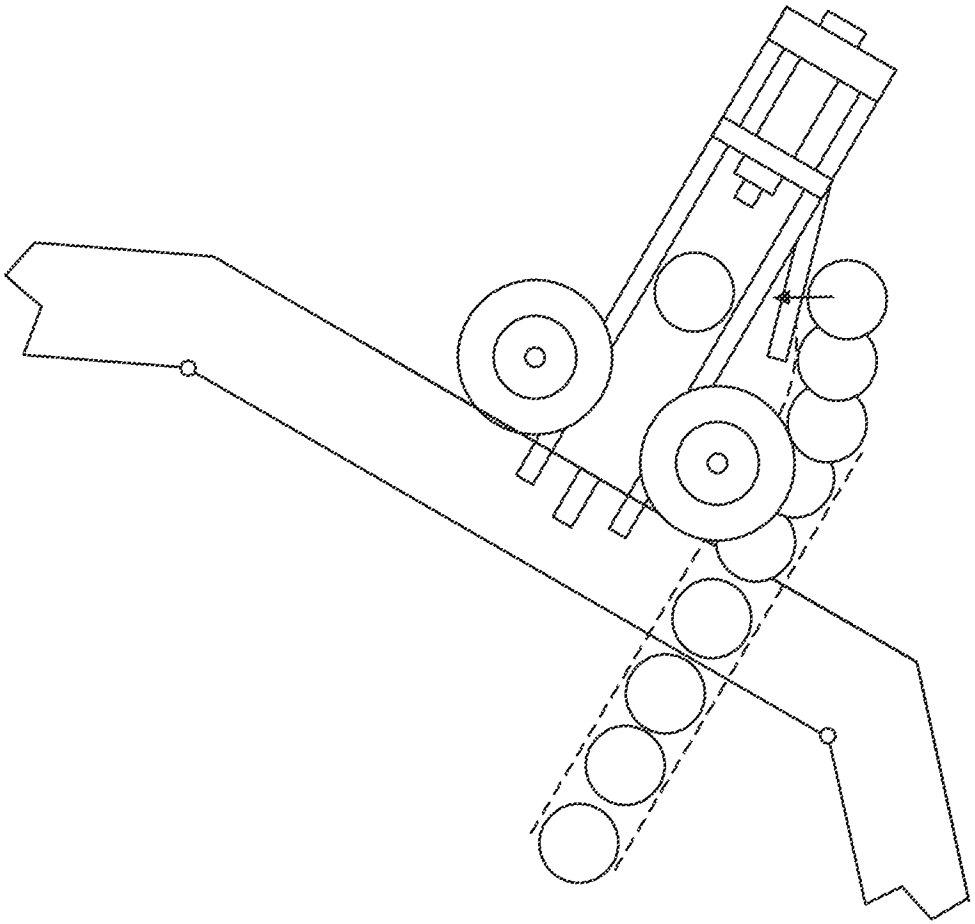
FIG. 13B is a top schematic view of the ball thrower.

With reference to FIG. 13, FIG. 13A, and FIG. 13B, also included in ARC 10 can be an electro-mechanical ball delivery component or thrower 1300 that receives balls from an actuator push arm 1310. In an embodiment, thrower 1300 includes two counter-rotating wheels that cooperatively act on a soccer ball to forcefully eject or throw the ball outwardly therefrom and onto and/or across a portion of platform 100 in a manner that can simulate, for example, a soccer ball that has been kicked or passed by another player to a player who is being trained in ARC 10. Thrower 1300 is supplied or fed soccer balls from silo 1100 by means of motorized gear and push arm assembly 700 that is controlled through VFD 420 as aforementioned. FIG. 13A specifically depicts actuator push arm 1310 that is provided near a top portion of silo 1100 and adjacent to thrower 1300. Actuator push arm 1310 is intended to sufficiently drive or push individual soccer balls sequentially into thrower 1300, in operation of an embodiment of a soccer training device and system including ARC 10.

With regard to control of the supply of soccer balls to silo 1100 and ultimately to thrower 1300 via push arm 1310, it is to be appreciated and understood that the aforementioned VFD 420 advantageously allows for delivery of more power at motorized gear and push arm assembly 700, and thus faster reaction time at distribution center 510, thereby advantageously resulting in more consistent delivery of balls to, and loading of balls in, sequentially, silo 1100. VFD 420 can be "tuned" with adjustments and/or programming as needed to compensate for and correct ball movement failures without stopping a training session or use of ARC 10 generally. VFD 420 can also be adjusted to reduce or in some cases even eliminate ball loading problems that may occur at a holding position in ball silo 1100 adjacent ball thrower 1300.

Figure 14:
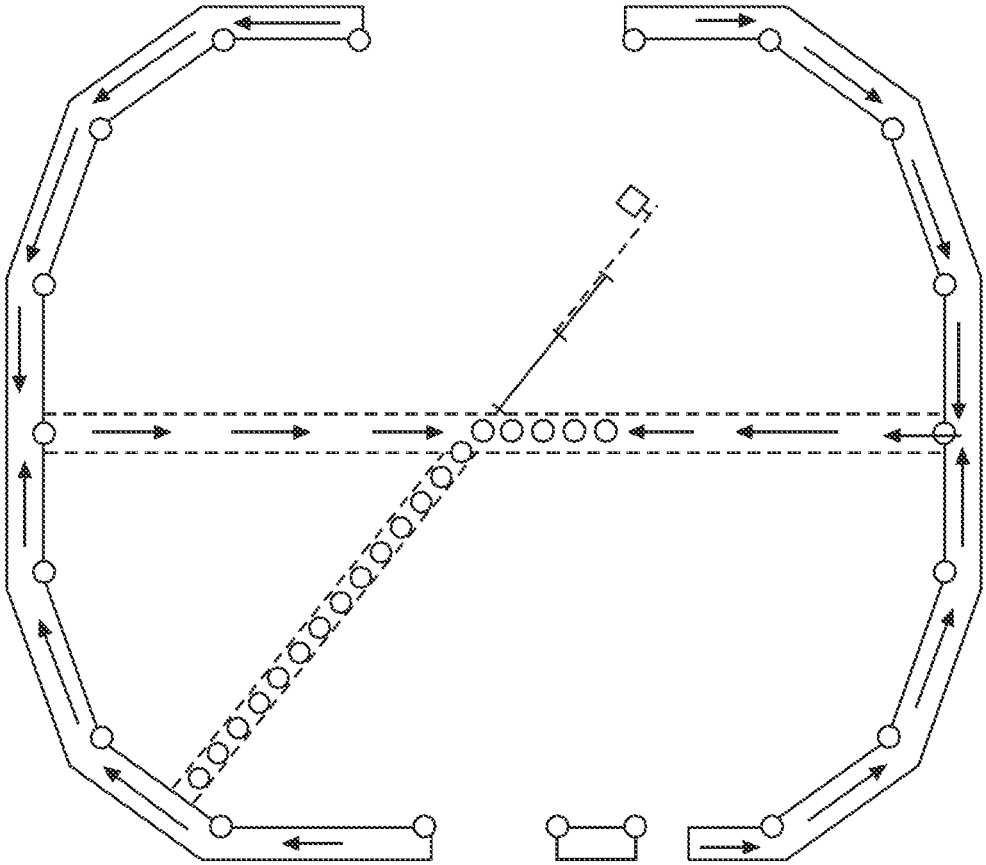
FIG. 14 is a top schematic depiction of a cycle of operation, of the soccer training device and system.

With particular reference now to FIG. 13, FIG. 13B, and FIG. 14, a cycle of operation of an embodiment of a soccer training device and system including ARC 10 is schematically depicted. In these figures and as stated below, reference letters such as (A), (B), etc., are used to identify components that are described by way of reference numerals in other figures. Specifically, in an embodiment of a soccer training device and system including ARC 10, an essentially closed-loop system delivers soccer balls to athletes on a main platform (I) by means of ball thrower (A). It is to be understood that the closed-loop system can also continue to run without a player to kick balls being delivered, due to the ball thrower being positioned directly opposite a sensored gate (B). Multiple sensored gates (C) are positioned around main platform (I). Platform (I) is enclosed by a barrier fence or "cage" that is generally disposed at and around outer bounds of platform (I) and vertically above platform (I) and the sensored gates (B) and (C) to keep balls contained within ARC 10. The sensored gate (B) and (C) are generally similar and essentially differ just in their respective locations around platform (I). When Ball 1 passes through a sensored gate (B) or (C), the sensor triggers a timer that is located in a control panel (D). Also, as Ball 1 passes through the gates, it is dampened by a curtain (M) comprising Mass Loaded Vinyl (N) to absorb impact force from Ball 1 and thereby allow Ball 1 to fall in to a sloped gravity assisted channel (O) that surrounds the enclosure. This sloped Peripheral Return Channel allows the balls to roll around ARC 10 to an opening that leads to a Distribution Center located under main platform (I) and consequently join and create a collection of balls (P) that are sequentially moving through the system. The timer then signals an actuator (E) behind ball thrower (A) to push another ball, Ball 2, forward to make contact with the counter-rotating wheels of the thrower (A) and thereby deliver Ball 2 to either a player that will pass or kick the ball through a sensored gate, or through Gate (B) without intervention by the player. At a time when Ball 2 is delivered by (or projected outwardly from) thrower (A), Ball 2 passes through another sensor (F) that is located just to an exit or delivery side of thrower (A). Sensor (F) then sends a signal to Variable Frequency Drive (VFD) (G) located in control panel (D). This VFD then triggers and controls an electric motor and chain drive push/rod system (H) located under the main platform (I), to push a collection of soccer balls (J) within and through a series of wheeled channels (K) to sequentially force Ball 3 to drop into a holding position (L) behind ball thrower (A) and in front of actuator (E), thus completing a cycle of the closed-loop system. The system is controlled by a control panel (D) that is preferably located outside of the player area/barrier fence or "cage". Control panel (D) includes a system power disconnect switch, the VFD, an emergency stop button, and controls for ball thrower (A) including on/off and left/right wheel speed controls.

Although not illustrated, it is to be appreciated and understood that in another embodiment of a soccer training device and system including ARC 10, panel (D) could also include a ball delivery selection switch to choose one of several ball throwers and that may be provided in such an embodiment along with other components that may be respectively associated with the several ball throwers.

In FIG. 15, an embodiment of a soccer training device and system including ARC 10 is depicted showing an example of an overall "process and flow" in use thereof. In an embodiment, one or more cameras (as shown in this example, "CamA", "CamB", and "CamC") can be provided to collect images and/or video of player activities and thereby provide visual analysis to improve a player's (and even a trainer's) ability to learn and improve in technical skills through automated processes of repetitively receiving and then passing or kicking soccer balls as aforedescribed. In one example of a soccer training device and system including ARC 10, it was determined that an integrated video element was useful in so improving players' skills and therefore cameras were permanently mounted to the barrier fence or "cage". In an embodiment, the cameras can be activated through an RFID card that players touch to a pad. A first touch of the card to the pad can turn the cameras on, and a second touch can turn the cameras off. Such video recordings can be stored and accessed for review and further instructional purposes. It is to be appreciated and understood that any suitable systems and techniques can be used as alternatives or additions to the aforementioned RFID system, and that such RFID or other identification or authentication systems can also be utilized for activation and operation of a soccer training device and system including ARC 10. In such a system, therefore, a single athlete could effectively start up and operate ARC 10 without needing another person to, for example, operate control panel 400 and/or control box 410.

Figure 16:
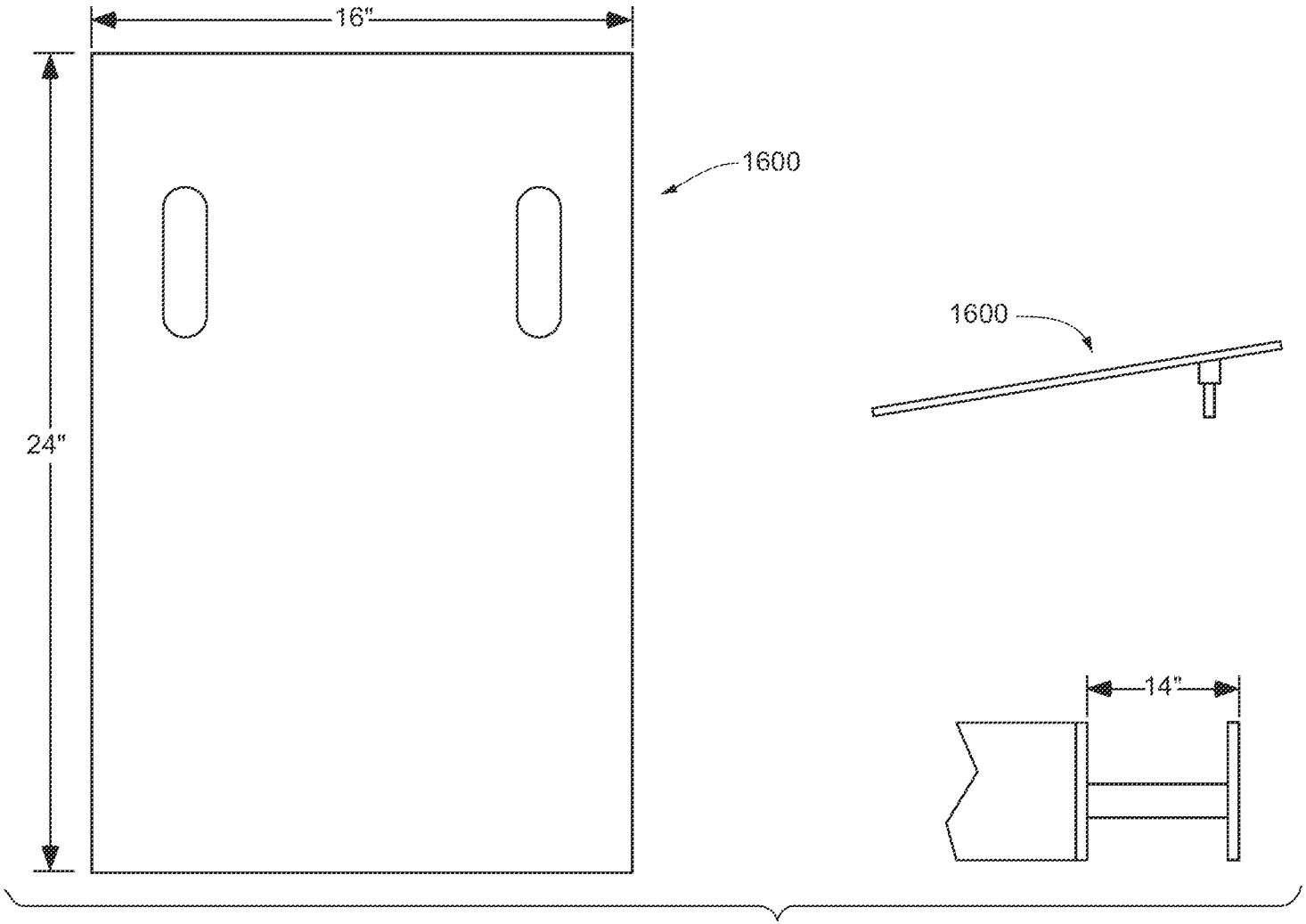
FIG. 16 is a schematic depiction of several views of an optional ramp, for the soccer training device and system.

In FIG. 16, an optional and portable inclined surface or "ramp" 1600 is depicted, to elevate, "lift", or "loft" balls being delivered by thrower 1300. Ramp 1600 is configured and constructed to be placed on platform 100 in a path of balls being projected from thrower 1300. Although not explicitly illustrated, it is also to be appreciated and understood that thrower 1300 could be titled from a generally horizontal position as another technique to elevate, "lift", or "loft" balls being delivered by thrower 1300 so that players can be trained on receiving balls being so elevated, lifted, or lofted.

Also, although they may not be explicitly illustrated in the figures, it is to be appreciated and understood that various embodiments of soccer training devices and systems including an ARC as aforedescribed by example can include: a plurality of ball throwers, to provide a plurality of ball delivery angles and options to players; and one or more perimeter area "bounding boards", that may optionally be color-coded for shot targeting, that are provided at desired locations around platform 100 to allow a player to increase their numbers of "touches" on a ball before playing the ball into a gate.

Furthermore, although not explicitly illustrated in the figures, it is to be appreciated and understood that an embodiment of a soccer training device and system including an ARC as aforedescribed by example can be of relatively larger dimensions, to simulate a "shooting" environment in which soccer balls are shot into a larger "goal" that comprises at least one sensored gate of relatively larger dimensions. Conversely, an embodiment of a soccer training device and system including an ARC as aforedescribed by example can be of relatively smaller dimensions, to provide a "solo" or compact training installation for perhaps one or two players within the barrier fence or "cage".

An ARC can be modified for use with other sports or leisure activities. Through a series of conveyor belts, balls and pucks can be moved through the system and delivered to players under same repetitive training process. Such other means of collecting, transporting, and delivering balls, pucks, etc. are known in the art and may be incorporated into the an ARC.

Figure 17:
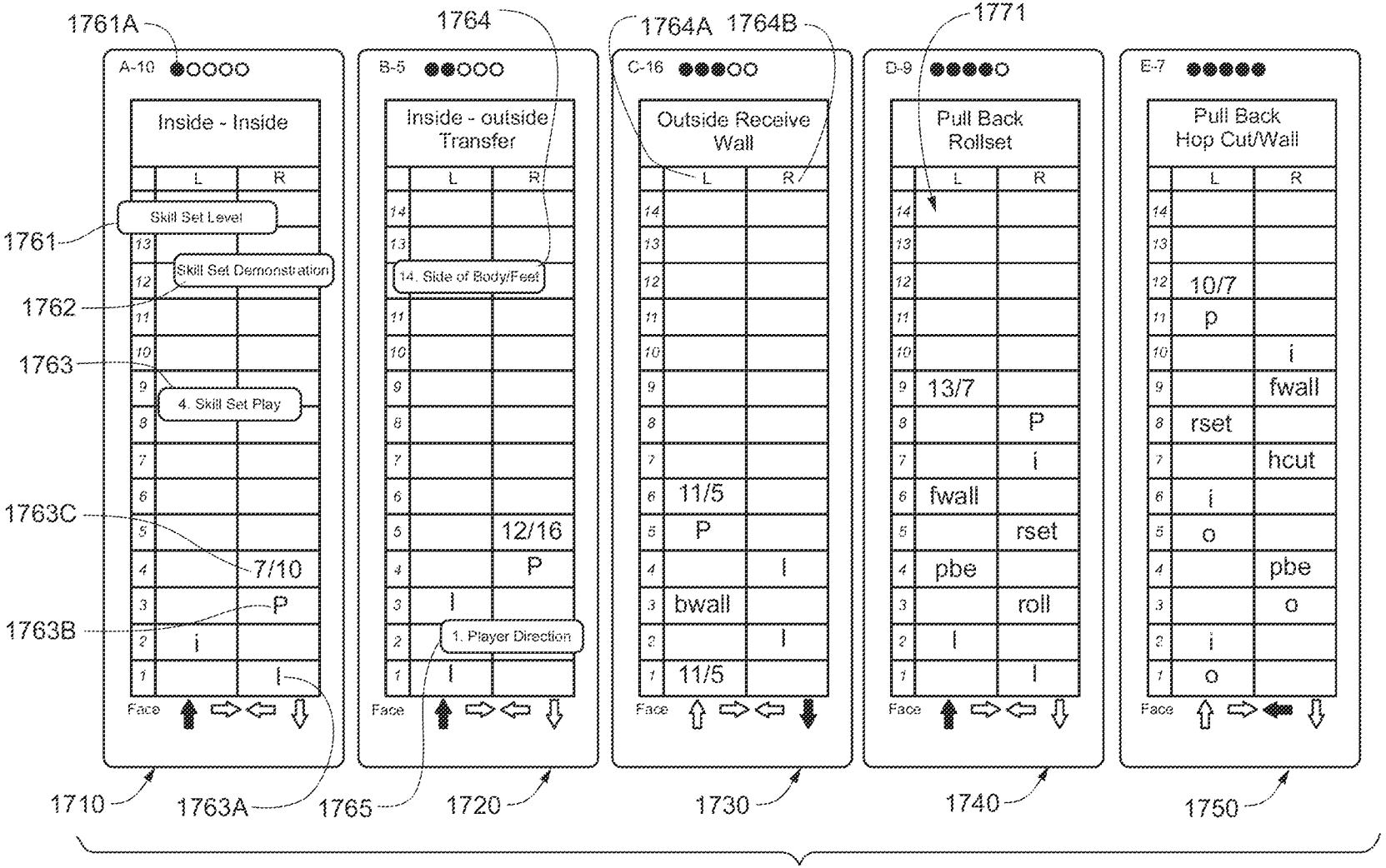
FIG. 17 is an illustration of an embodiment of training cards that can be used as a training method incorporating an ARC.

With reference now to all of the figures, and particularly FIG. 17, an "ARC Soccer Training Method" ("ASTM") can be used to train soccer players, specifically using a soccer training device and system including an ARC as aforedescribed by example.

The ASTM gives direction to trainers to use a soccer training device and system, including an ARC, effectively and consistently. The ASTM can easily be instructed and used by virtually any level soccer trainer to (i) guide trainees to correctly use the ARC, (ii) know how to progress trainees during a single training session, and (iii) progress a trainee from one training session to another in use of the ARC.

Irrespective of particular details of a particular training method utilizing a soccer training device and system, including an ARC, it is to be appreciated and understood that the ASTM is intended to help a trainee improve their "first touch." Improving first touch would include controlling and maintaining close proximity to the ball when the ball is received. It also consists of "cleanliness" when receiving a ball, meaning keeping the ball in control to receive it in a way to either move the ball on to another teammate (pass), possess the ball through space (dribbling), shooting the ball on goal, or clearing the ball out of danger.

The ASTM relies significantly on repetition and consistency; and by using an ARC, the ASTM can remove unwanted variability of how a ball is delivered and the timing of how the ball is delivered. ASTM uses multiple foot surfaces for receiving and moving a ball through space, which is lacking in most traditional training methods.

Other Examples and Embodiments

Although not illustrated, a data base of the skill set cards can be accessed by a touch screen located at the control panel of the ARC. Skill sets would be picked via touch screen and displayed on a touch screen device or other suitable display means for an ARC. These training sessions could then be filed, either tangibly or electronically, in a trainee file for future use and reference.

Although not illustrated, a computer application can be downloaded onto a smart phone, tablet computer, or mobile device by ARC users. It is to be appreciated and understood that any embodiments of subject matter descried by example or otherwise contemplated herein can be accomplished electronically through a suitable "app" that is developed and downloaded to such a device.

Although not illustrated, ASTM Virtual Training can include a qualified ARC trainer who is able to train another trainer via onsite video at an offsite location by way of, for example, wireless communication systems and protocols such as "blue tooth" devices. Video taken at multiple angles in an installation of an ARC can be transmitted to an offsite location for use, study, and reference accordingly.

Various embodiments of systems, devices, and methods have been described herein. These embodiments are given only by way of example and are not intended to limit the scope of subject matter hereof. It should be appreciated, moreover, that the various features of the embodiments that have been described may be combined in various ways to produce numerous additional embodiments. Moreover, while various materials, dimensions, shapes, configurations and locations, etc. have been described for use with disclosed embodiments, others besides those disclosed may be utilized commensurate with the scope of subject matter hereof.

ASTM can use coded cards, as shown in FIG. 17, to indicate what series of foot skills (or "skill sets") to use to instruct trainees in an embodiment of a soccer training device and system including an ARC. The coded cards indicate with what foot, left or right, the trainee will receive a ball, what direction they should face while receiving the ball, what skill set they will perform, and through which sensored gate the trainee will play the ball with a designated foot.

The coded cards (1710, 1720, 1730, 1740, 1750) are rated for difficulty on a 1-5 scale, to give a trainer utilizing the ARC Device and System guidance in building a training session and progressing a trainee from session to session. The ASTM is designed to use one or more of such ASTM cards to build a training session, giving the trainee and trainer guidance in the use of the ARC 10. It gives the trainer flexibility to build any desired number of training sessions, using individual training cards.

The training method uses the ARC's 10 consistent delivery of a soccer ball and high repetition, which assists in the neuromuscular training they need, to be able to improve their first touch and improve their control of the ball. This training method also works on improving a trainee's reaction time, foot speed, agility, balance and coordination, all critical components in developing today's successful soccer player. The ASTM uses multiple surfaces of the feet to receive and pass a ball, something often missing in traditional training methods. The ASTM skill sets are designed to work both left and right feet, to better balance a soccer player's skills.

The ARC Soccer Training Method (ASTM) includes a series of training cards (FIG. 17). Each card (1710, 1720, 1730, 1740, 1750) represents one skill set used in The Arc Device and System. A Skill Set Level is considered the difficulty rating 1761 for each skill set and is indicated by shaded circles at the top of the card. The ASTM Skill Set Description 1762 is indicated at the top of the card and indicates a general description of the skill set. The Skill Set Steps 1763 indicate the actual skill development steps a player will use to achieve a particular skill. One column is vertically oriented on the card to indicate the number of skill set steps a player will execute to complete the skill set. Each card has an indication of the foot or side of the body (left or right) a player will use on each given skill set step. This side of the body or foot is indicated by an "L" 1764A or an "R" 1764B at the top of the two vertical columns. The direction the trainee faces to start the skill set is indicated with arrows at the bottom of the card 1765. These arrows can be shaded or circled to indicate the direction a player will face when initially receiving a ball.

The skill set starts by indicating what surface of the foot receives the ball in the bottom of column #1 (4) with a symbol i.e.: i=inside of foot, either in the left "foot" column or the right "foot" column. The skill set progresses upward in the columns (4) indicating which foot, left or right, is used, and what surface of foot is used. It also can indicate a certain skill set to perform, (e.g. pen=pendulums). The last entry in the columns indicates through which gate in the ARC Device and System a trainee should play the ball.

An ASTM Key for the symbols used for an embodiment the ASTM skill set cards is provided below. The letters indicate either foot surface that receives the ball in that part of the sequence or a skill set they will be asked to perform. Other symbols may be added to add detail to the ASTM.

i=inside of foot p=play
o=outside of foot PBk=Pull Back
s=sole of foot PBe=Pull Behind
roll=roll rset=roll set
f wall=play front wall Pen=pendulum
b wall=play back wall It is to be appreciated and understood that other symbols can, alternatively and/or additionally, be used, for example, to indicate skills being trained.

Example 1

Example 1 of the ASTM is presented by card 1710. The name of the skill set 1762 for this card is "Inside-Inside." The level 1761 is indicated as being "Level 1" by a single skill level circle 1761A being shaded. The trainee faces forward and toward the direction a ball will be delivered or served in the ARC 10, as indicated by the up arrow shaded 1765A. The trainee will receive the ball with the inside of their right foot 1763A The skill set then progresses upward along the columns 1771 to receive the ball with the inside of the left foot. The 3rd step is to play (P) the ball through with the right foot 1763B through the 7th gate in the ARC Device and System. The 4th horizontal column 1763C has two numbers separated by an angled line "7/10". This indicates the skill can also be reversed by starting the skill set by receiving the ball with the inside of the left foot, receive inside of right foot and play with the left foot through gate #10 in the ARC 10. Having two numbers in the final skill set box, eliminates the need for the same skill set to have a different card for left and right sided play.

Example 2

Example 2 of the ASTM is presented by card 1720. The name of the skill set 1762 is "Inside-Outside-Transfer." The level 1761 is indicated as being "Level 2" by two skill level circles 1761A being shaded. The player starts by facing forward towards the ball delivery area of the ARC 10 as indicated by the upward arrow 1765 shaded. The player receives the ball with the inside of the left foot, receives next with the outside of the right foot, receives with the inside of the left foot and then plays (P) the ball in to the #12 gate of the ARC 10 with their right foot. This can also be reversed by starting the sequence with the inside of their right foot and ending the skill set by playing the left foot in to gate #6 of the ARC 10.

Example 3

Example 3 of the ASTM is presented by card 1730. The name of the skill set 1762 is "Outside Receive Wall." The level 1761 is indicated as being "Level 3" by three skill level circles 1761A being shaded. The player starts by facing away from the ball delivery area of the ARC 10, as indicated by the downward arrow 1765 shaded. The ball is delivered and the player facing away lets the ball roll by and receives the ball with the outside of the right foot to the inside of the right foot, plays the back wall ("bwall") with their left foot, receives back from the wall with the inside of the right foot and then plays with left foot in to gate #11 of the ARC10. This skill can also be reverse as indicated by 11/5 in the last skill set box.

Example 4

Example 4 of the ASTM is presented by card 1740. The name of the skill set 1762 is "Pull Back Rollset." The level 1761 is indicated as being "Level 4" by four skill level circles 1761A being shaded. The player starts by facing the ball delivery, as indicated by the upward arrow shaded 1765. The player receives the ball with the inside of the right foot, receives inside left foot, rolls the ball across the front with the right foot, performs a pull behind with the left foot. The player then does a roll set with the right foot to play off of the front wall ("fwall") with the left foot, receives off the wall with the inside of the right foot and then plays with the right foot in to the Arc 10 gate #13. This can also be reversed as indicated by 13/7 in the last skill set box.

Example 5

Example 4 of the ASTM is presented by card 1750. The name of the skill set 1762 is "Pull Back Hop Cut/Wall." The level 1761 is indicated as being "Level 5" by five skill level circles 1761A being shaded. The player starts by facing to the left of the ball delivery area of the ARC10 as indicated by the left arrow shaded 1765. The player receives the ball with the outside of the left foot, plays with the inside of the left foot, receives with the outside of the right foot and performs a pull-behind with the right foot. The player then receives with the outside of the left foot, plays with the inside of the left foot and performs a hop-cut. The player performs a roll-set with the left foot and plays off the wall with the right foot and receives from the wall with the inside of the right foot. The player receives with the left foot and plays in to gate #10 of the ARC 10 with their left foot. This skill set can be reversed as indicated by the 10/7 in the last skill set box.

The individual skill set cards (e.g., 1710) will be filed in to categories of what the skill set is working to try to improve. This further categorization of the skill sets, beyond difficulty level, gives direction and purpose to a training session on what the skill set or session is working on accomplishing. Categories for the ASTM are as follows, but not limited to:

Transfer: Being able to move the soccer ball from one side of the body to the other and continue to play.

Angle: Being able to recognize at what angle a ball needs to be played to reach its target. Correctly positioning the body to anticipate the path the ball will travel in order to receive it.

Weight/Pace: Being able to recognize the speed a ball is approaching and applying the appropriate counter force to slow and or stop the ball, while still maintaining close player to ball proximity (weight). Being able to apply a force to the ball, in order for the ball to reach its desired target in the desired time (pace).

Balance and Agility: Improving a player's body awareness and coordination in order to move through space and control a ball while still maintaining control of their body. Quick and smooth movements to receive, transfer and deliver a ball to a target.

Accuracy: Improving a player's precision in receiving a soccer ball on the correct part of their foot and with the correct foot position. Improving a player's ability to accurately deliver a ball to a desired target.

Speed of Play: Improving a player's ability for quick release and movement of the soccer ball while still maintaining control of the ball. Also, can be fast movement of the soccer ball from one player to another player using one or two touch passing.

Aerial Control: Improving a player's ability to take down air balls with their body and settle the ball out of the air quickly and cleanly and move to a target.

Targeting: A player recognizing where on their body they should be receiving the ball in order to target the ball to move in the direction they want and control.

Cards can also be categorized in to 3 different card sets to indicate if they are used for (1) Warm-Up Set, (2) Tracker Set, (3) Standard Set. Warm-up sets are used at the beginning of a session and are labeled for difficulty. Tracker Sets are labeled for difficulty and are used to track a player's improvement in areas of speed of play and accuracy of passing through the correct gate of the ARC 10 with the set. Standard Sets are used during a standard training session to help players develop improved technical skills.

Tracking sheets can be used in the ASTM to allow players to be trained consistently from session to session, and from trainer to trainer. Tracking sheets have areas to document a player's Warm-Up Set, Tracker Set and Standard Sets being worked on in a session. Trainers are then able to see how to progress a player from session to session, and how to train a player that they have never trained before. Tracking sheets also have areas to document number of repetitions of a Tracker Set, and accuracy of passing through the correct gate. Tracker Sheets allow more consistency with using the ASTM and an ability to track and document a player's progress in training.

Irrespective of a particular embodiment of a soccer training device and system including ARC 10, and/or an ASTM, as described by example or otherwise contemplated herein, it is to be particularly appreciated and understood that use of an ARC and/or an ASTM can provide consistent and predictable delivery and collection of soccer balls to trainees. As such, an ARC and/or an ASTM can improve technical skills of "average" soccer players by allowing them to repetitively and consistently receive and address (e.g., pass or shoot) soccer balls. These training systems and methods can increase muscle memory and mental/physical coordination and recall in receiving and addressing soccer balls. It is also to be appreciated that use of an ARC can provide relatively more consistent delivery and collection of balls than use of conventional means—whether human or mechanical—due to the substantially automated and closed-loop operation of an ARC as aforementioned.

Furthermore, and again irrespective of a particular embodiment of a soccer training device and system including ARC 10, and/or an ASTM, as described by example or otherwise contemplated herein, it is to be particularly appreciated and understood that use of an ARC and/or an ASTM can efficiently train players in these technical skills when time is a limiting factor. Players, coaches, and soccer fields are often time-constrained and the time of coaches and fields (e.g., hourly training and use rates) can be costly even if attempts are made to utilize them efficiently. But use of a soccer training device and system including ARC 10, and/or an ASTM, can enable players and coaches to consistently, predictably, and continually deliver and collect soccer balls in a highly efficient and cost-effective environment.

Persons of ordinary skill in the relevant arts will recognize that subject matter hereof may comprise fewer features than illustrated in any individual embodiment described above. The embodiments described herein are not meant to be an exhaustive presentation of the ways in which the various features of subject matter hereof may be combined. Accordingly, the embodiments are not mutually exclusive combinations of features; rather, the subject matter hereof may comprise a combination of different individual features selected from different individual embodiments, as understood by persons of ordinary skill in the art.

Any incorporation by reference of documents above is limited such that no subject matter is incorporated that is contrary to the explicit disclosure herein. Any incorporation by reference of documents above is further limited such that no claims included in the documents are incorporated by reference herein. Any incorporation by reference of documents above is yet further limited such that any definitions provided in the documents are not incorporated by reference herein unless expressly included herein.

For purposes of interpreting the claims of subject matter hereof, it is expressly intended that the provisions of Section 112, sixth paragraph of 35 U.S.C. are not to be invoked unless the specific terms "means for" or "step for" are recited in a claim.

The invention claimed is:

1. A soccer training system, comprising:

(i) a soccer training device, including:

a generally horizontal and planar platform;

at least one sloped soccer ball collection trough provided generally around a perimeter of the platform;

a segmented cage provided generally at and around outer bounds of, and vertically above, the platform;

at least one sensored gate disposed at the outer bounds of the platform including at least one soccer ball impact curtain provided above the at least one soccer ball collection trough to direct soccer balls into the trough, and at least one arrangement of sensors to sense presence of the soccer balls that are impacting the at least one impact curtain;

at least one sloped return chute that is provided primarily under the platform and is adapted to receive the soccer balls from the collection trough;

a ball thrower disposed at the outer bounds of the platform that sequentially receives the soccer balls from the return chute, to sequentially deliver the soccer balls substantially horizontally and substantially parallel to the platform to a player on the platform; and a control panel and a control box, for controlling operation of the soccer training device and system;

wherein the arrangement of sensors provides a signal to the control panel and control box to deliver a ball to a player on the platform; and wherein the at least one sensored gate is disposed opposite the ball thrower; and (ii) at least one skill set card adapted for use in operating the soccer training device, said at least one card providing suggested use of the soccer training device to improve a player's technical skill through repetitively receiving, passing, or kicking soccer balls.

2. The soccer training system of claim 1, wherein the at least one skill set card is a coded card.

3. The soccer training system of claim 1, wherein the at least one skill set card includes a skill set level of difficulty.

4. The soccer training system of claim 1, wherein the suggested use of the soccer training device includes a direction in which the player faces.

5. The soccer training system of claim 1, wherein the suggested use of the soccer training device includes a skill set to be executed by the player.

6. The soccer training system of claim 5, wherein the skill set is defined by a level of difficulty.

7. The soccer training system of claim 1, wherein the suggested use of the soccer training device includes playing the ball to the gate.

8. The soccer training system of claim 1, wherein the suggested use of the soccer training device includes accuracy.

9. The soccer training system of claim 1, wherein the suggested use of the soccer training device includes targeting.

10. The soccer training system of claim 1, wherein the at least one skill set card is an electronic card.

11. The soccer training system of claim 1, wherein the at least one skill set card is accessed via an electronic display.

12. The soccer training system of claim 1, wherein said soccer training device is situated at a first location and is operated by a trainer situated at a second location.

* * * * *